US007413841B2

(12) United States Patent
Yuasa

(10) Patent No.: US 7,413,841 B2
(45) Date of Patent: Aug. 19, 2008

(54) TONER, PROCESS FOR PRODUCING THE SAME, TWO-COMPONENT DEVELOPING AGENT AND METHOD OF IMAGE FORMATION

(75) Inventor: Yasuhito Yuasa, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 481 days.

(21) Appl. No.: 10/542,518

(22) PCT Filed: Jan. 16, 2004

(86) PCT No.: PCT/JP2004/000348

§ 371 (c)(1),
(2), (4) Date: Jul. 14, 2005

(87) PCT Pub. No.: WO2004/079457

PCT Pub. Date: Sep. 16, 2004

(65) Prior Publication Data

US 2006/0147828 A1 Jul. 6, 2006

(30) Foreign Application Priority Data

Jan. 17, 2003 (JP) ..... 2003-009462

(51) Int. Cl.
*G03G 5/00* (2006.01)

(52) U.S. Cl. ..... 430/137.14; 430/108.4; 430/108.8; 430/110.2; 430/123.5; 430/123.52

(58) Field of Classification Search ..... 430/108.4, 430/108.8, 110.2, 123.5, 123.52, 137.14
See application file for complete search history.

(56) References Cited

U.S. PATENT DOCUMENTS 4,777,104 A 10/1988 Matsumoto et al.

(Continued)

FOREIGN PATENT DOCUMENTS

CN 1166626 12/1997

(Continued)

OTHER PUBLICATIONS

PTO-892 for co-pending U.S. Appl. No. 10/533,231.

*Primary Examiner*—Mark A Chapman
(74) *Attorney, Agent, or Firm*—Hamre, Schumann, Mueller & Larson, P.C.

(57) ABSTRACT

Toner includes aggregated particles including at least resin particles, pigment particles, and wax particles. A fused film of the resin is formed on the surface of the toner. The wax is at least one selected from A: ester wax that has an iodine value of not more than 25, a saponification value of 30 to 300, and an endothermic peak temperature (melting point) of 50° C. to 100° C. based on a DSC method; and B: wax that is obtained by a reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melted point) of 50° C. to 120° C. based on the DSC method. The toner and a two-component developer can achieve oilless fixing that prevents offset without using oil while maintaining high OHP transmittance, can eliminate spent of the toner components on a carrier to make the life longer, and can ensure high transfer efficiency by suppressing transfer voids or scattering during transfer.

10 Claims, 5 Drawing Sheets

U.S. PATENT DOCUMENTS

| | | | |
|---|---|---|---|
| 4,996,127 | A | 2/1991 | Hasegawa et al. |
| 5,567,561 | A | 10/1996 | Yoshikawa et al. |
| 5,702,859 | A | 12/1997 | Kubota et al. |
| 5,766,814 | A | 6/1998 | Baba et al. |
| 5,849,456 | A | 12/1998 | Matsumura et al. |
| 5,888,687 | A | 3/1999 | Matsumura et al. |
| 5,910,389 | A | 6/1999 | Matsumura et al. |
| 5,998,078 | A | 12/1999 | Suwabe et al. |
| 6,080,519 | A | 6/2000 | Ishiyama et al. |
| 6,106,986 | A | 8/2000 | Shirai et al. |
| 6,117,607 | A | 9/2000 | Shimizu et al. |
| 6,270,937 | B2 | 8/2001 | Yuasa et al. |
| 6,326,116 | B2 | 12/2001 | Yuasa et al. |
| 6,408,155 | B1 | 6/2002 | Tajima et al. |
| 6,432,599 | B1 | 8/2002 | Yuasa et al. |
| 6,544,707 | B2 | 4/2003 | Nakamura et al. |
| 6,579,653 | B1 | 6/2003 | Yuasu et al. |
| 2002/0042012 | A1 | 4/2002 | Mitsuhashi et al. |
| 2002/0064401 | A1 | 5/2002 | Ashikari |
| 2002/0064724 | A1 | 5/2002 | Nakamura et al. |
| 2002/0086229 | A1 | 7/2002 | Yuasa et al. |
| 2002/0127030 | A1 | 9/2002 | Yoda et al. |
| 2003/0027072 | A1 | 2/2003 | Horiuchi et al. |
| 2003/0152856 | A1 | 8/2003 | Mizoe et al. |

FOREIGN PATENT DOCUMENTS

| | | |
|---|---|---|
| CN | 1246659 | 3/2000 |
| CN | 1086232 | 6/2002 |
| EP | 0 606 074 | 7/1994 |
| JP | 61-80161 | 4/1986 |
| JP | 61-80162 | 4/1986 |
| JP | 61-80163 | 4/1986 |
| JP | 2-266372 | 10/1990 |
| JP | 2-271364 | 11/1990 |
| JP | 5-27476 | 2/1993 |
| JP | 5-188632 | 7/1993 |
| JP | 5-333584 | 12/1993 |
| JP | 6-89045 | 3/1994 |
| JP | 8-314184 | 11/1996 |
| JP | 2619439 | 3/1997 |
| JP | 9-281748 | 10/1997 |
| JP | 10-20563 | 1/1998 |
| JP | 2744790 | 2/1998 |
| JP | 10-123748 | 5/1998 |
| JP | 10-198070 | 7/1998 |
| JP | 2801507 | 7/1998 |
| JP | 10301332 | 11/1998 |
| JP | 11-2922 | 1/1999 |
| JP | 11-143125 | 5/1999 |
| JP | 11-231570 | 8/1999 |
| JP | 11-327201 | 11/1999 |
| JP | 2000-10338 | 1/2000 |
| JP | 2000-214638 | 8/2000 |
| JP | 2000-267348 | 9/2000 |
| JP | 2001-209209 | 8/2001 |
| JP | 2001-249511 | 9/2001 |
| JP | 2002-6537 | 1/2002 |
| JP | 2002-14489 | 1/2002 |
| JP | 2002-23429 | 1/2002 |
| JP | 2002-148858 | 5/2002 |
| JP | 2002-229248 | 8/2002 |
| JP | 2002-229250 | 8/2002 |
| JP | 2002-278153 | 9/2002 |
| JP | 2002-296829 | 10/2002 |
| JP | 2002-311784 | 10/2002 |
| JP | 2002-341585 | 11/2002 |

TONER, PROCESS FOR PRODUCING THE SAME, TWO-COMPONENT DEVELOPING AGENT AND METHOD OF IMAGE FORMATION

TECHNICAL FIELD

The present invention relates to toner used, e.g., in copiers, laser printers, plain paper facsimiles, color PPC, color laser printers, color facsimiles or multifunctional devices, a method for producing the toner, a two-component developer, and an image forming method.

BACKGROUND ART

In recent years, electrophotographic apparatuses, which commonly were used in offices, have been used increasingly for personal purposes, and there is a growing demand for technologies that can achieve, e.g., a small size, a high speed, high image quality, or high reliability for those apparatuses. Under such circumstances, a cleanerless process, a tandem color process, and oilless fixing are required along with better maintainability and less ozone emission. The cleanerless process allows residual toner in transfer to be recycled for development without cleaning. The tandem color process enables high-speed output of color images. The oilless fixing can provide clear color images with high glossiness, transmittance, and offset resistance, even if no fixing oil is used to prevent offset during fixing. These functions should be performed simultaneously, and therefore improvements in the toner characteristics as well as the processes are important factors.

For color printers, a color process employing a four-pass system has been put to practical use. In this color process, an image support member (referred to as a photoconductive member in the following) is charged by corona discharge with a charger, and then is exposed to light signals for a latent image of each color to form an electrostatic latent image. The electrostatic latent image is developed by a first color of toner, e.g., yellow toner, to form a visible image. Then, a transfer member charged with the opposite polarity to that of the charged yellow toner comes into contact with the photoconductive member so that the yellow toner image formed on the photoconductive member is transferred. The photoconductive member is cleaned by removing residual toner that has not been transferred, and the development and transfer of the first color toner ends with discharging the photoconductive member. Subsequently, the same operations as those for the yellow toner are repeated for toner of colors such as magenta and cyan. The toner images of the colors are superimposed on the transfer member so as to form a color image. Then, the superimposed toner image is transferred to paper charged with the opposite polarity to that of the toner.

A tandem color process employing the following configuration also has been proposed. A plurality of image forming stations, each of which includes a charger, a photoconductive member, and a developing unit, are arranged in a row. A first transfer process is performed by successively transferring each color of toner to an endless transfer member in contact with the photoconductive members, so that multilayer transfer color toner images are formed on the transfer member. Then, a second transfer process is performed such that the multilayer toner images formed on the transfer member are transferred collectively to a transfer medium such as paper, an overhead projector (OHP) sheet, or the like. Another tandem color process also has been proposed in which toner continuously is transferred directly to the transfer medium without using the transfer member.

In a fixing process for color images, color toner should be melted and mixed to increase the transmittance. A melt failure of the toner may cause light scattering on the surface or the inside of the toner images, and the original color of the toner pigment is affected. Moreover, light does not reach the lower layer of the superimposed images, resulting in poor color reproduction. Therefore, it is essential for the toner to have a complete melt property and transmittance high enough not to reduce the original color. The light transmittance for an OHP sheet also is a necessary property for the color toner.

When color images are formed, toner may adhere to the surface of a fixing roller and cause offset. Therefore, a large amount of oil or the like should be applied to the fixing roller, which makes the handling or configuration of equipment more complicated. Thus, oilless fixing (no oil is used for fixing) is required to provide compact, maintenance-free, and low-cost equipment. To achieve the oilless fixing, e.g., toner in which a release agent (wax) is added to a binder resin with a sharp melt property is being put to practical use.

However, such toner is very prone to a transfer failure or disturbance of the toner images during transfer because of its strong cohesiveness. Therefore, it is difficult to ensure compatibility between transfer and fixing. In the case of two-component development, spent (i.e., a low-melting component of the toner adhering to the surface of a carrier) is likely to occur by heat generated by mechanical collision or friction between the particles or between the particles and the developing unit. This decreases the charging ability of the carrier and interferes with a longer life of the developer.

Japanese patent No. 2801507 (Patent Document 1) discloses a carrier for positively charged toner that is obtained by introducing a fluorine-substituted alkyl group into a silicone resin of the coating layer. JP 2002-23429 A (Patent Document 2) discloses a coating carrier that includes conductive carbon and a cross-linked fluorine modified silicone resin. This coating carrier is considered to have high development ability in a high-speed process and maintain the development ability for a long time. While taking advantage of superior charging characteristics of the silicone resin, the conventional technique uses the fluorine-substituted alkyl group to obtain properties such as slidability, releasability, and repellency, to increase resistance to wearing, peeling, or cracking, and further to prevent spent. However, the resistance to wearing, peeling, or cracking is not sufficient. Moreover, when the negatively charged toner is used, the amount of charge is excessively small, although the positively charged toner may have an appropriate amount of charge. Therefore, the reversely charged toner (positively charged toner) is generated significantly, which leads to fog or toner scattering. Thus, the toner is not suitable for practical use.

Various configurations of toner also have been proposed. It is well-known that toner for electrostatic charge image development used in an electrophotographic method generally includes a resin component (binder resin), a coloring component including a pigment or dye, a plasticizer, a charge control agent, and an additive, if necessary, such as a release agent. As the resin component, natural or synthetic resin may be used alone or in combination.

After the additive is pre-mixed in an appropriate ratio, the mixture is heated and kneaded by thermal melting, pulverized by an air stream collision board system, and classified as fine powders, thus producing a toner base. In this case, the toner base also may be produced by a chemical polymerization method. Then, an additive such as hydrophobic silica is added to the toner base, so that the toner is completed. The single component development typically uses toner only, and the two-component development uses a developer including toner and a carrier of magnetic particles.

Even with pulverization and classification of the conventional kneading and pulverizing processes, the actual particle size can be reduced to only about 8 μm in view of the economic and performance conditions. At present, various methods are considered to produce toner having a smaller particle size. In addition, a method for achieving the oilless fixing also is considered, e.g., by adding a release agent (wax) to a resin with a low softening point during melting and kneading. However, there is a limit to the amount of wax to be added, and increasing the amount of wax can cause problems such as low flowability of the toner, transfer voids, or a fusion of the toner to the photoconductive member.

Therefore, various ways of polymerization different from the kneading and pulverizing processes have been studied as a method for producing toner. For example, toner may be produced by suspension polymerization. However, the particle size distribution is no better than that of the kneading and pulverizing processes, and in many cases further classification is necessary. Moreover, since the toner is almost spherical in shape, the cleaning property is extremely poor when the toner remains on the photoconductive member or the like, and thus the reliability of image quality is reduced.

Toner may be produced by emulsion polymerization including the following steps: preparing an aggregated particle dispersion by forming aggregated particles in a dispersion of at least resin particles; forming adhesive particles by mixing a resin particle dispersion in which resin fine particles are dispersed with the aggregated particle dispersion so that the resin fine particles adhere to the aggregated particles; and heating and fusing the adhesive particles together.

JP 10(1998)-198070 (Patent Document 3) discloses a method for producing toner for electrostatic charge image development. The method includes the following steps: preparing a resin particle dispersion by dispersing resin particles in a surface-active agent having a polarity; preparing a coloring agent particle dispersion by dispersing coloring agent particles in a surface-active agent having a polarity; and preparing a liquid mixture by mixing at least the resin particle dispersion and the coloring agent particle dispersion. According to this method, the surface-active agents included in the liquid mixture have the same polarity, so that reliable toner with excellent charge and color development properties can be produced in a simple and easy manner.

JP 10(1998)-301332 (Patent Document 4) discloses a method for producing toner with an excellent fixing property, color development property, transparency, and color mixing property. According to this method, a release agent includes at least one kind of ester that contains at least one selected from higher alcohol having a carbon number of 12 to 30 and higher fatty acid having a carbon number of 12 to 30, and resin particles include at least two kinds of resin particles with different molecular weights.

As the release agent, e.g., low molecular-weight polyolefins such as polyethylene, polypropylene, and polybutene, silicones, fatty acid amides such as oleamide, erucamide, amide ricinoleate, and amide stearate, vegetable waxes such as carnauba wax, rice wax, candelilla wax, Japan wax, and jojoba oil, animal waxes such as beeswax, mineral/petroleum waxes such as montan wax, ozocerite, ceresin, paraffin wax, microcrystalline wax, and Fischer-Tropsch wax, and modified waxes thereof are disclosed.

However, when the dispersibility of the release agent added is lowered, the toner images melted during fixing are prone to a dull color. This also decreases the pigment dispersibility, and thus the color development property of the toner becomes insufficient. In the subsequent process, when resin fine particles further adhere to the surface of an aggregate, the adhesion of the resin fine particles is unstable due to low dispersibility of the release agent or the like. Moreover, the release agent that once was aggregated with the resin particles is liberated into an aqueous medium. Depending on the polarity or the thermal properties such as a melting point, the release agent may have a considerable effect on aggregation. Further, a specified wax is added in a large amount to achieve the oilless fixing. Therefore, it is difficult to aggregate the wax with the resin particles that differ from the wax in melting point, softening point, and viscoelasticity and to fuse them together uniformly by heating. In particular, the use of a release agent having a predetermined acid value and a functional group may achieve the oilless fixing, reduce fog during development, and improve the transfer efficiency. However, such a release agent prevents uniform mixing and aggregation of the resin particles with pigment particles in an aqueous medium during manufacture. Thus, there is a tendency to increase the presence of release agent or pigment suspended in the aqueous medium.

Patent Document 1: Japanese Patent No. 2801507
Patent Document 2: JP 2002-23429 A
Patent Document 3: JP 10(1998)-198070 A
Patent Document 4: JP 10(1998)-301332 A

DISCLOSURE OF INVENTION

It is an object of the present invention to provide toner, a two-component developer, and an image forming method that can achieve oilless fixing that prevents offset without using oil while maintaining high OHP transmittance, can eliminate spent of the toner components on a carrier to make the service life longer, and can ensure high transfer efficiency by suppressing transfer voids or scattering during transfer.

Toner of the present invention includes aggregated particles including at least resin particles, pigment particles, and wax particles. A fused film of the resin is formed on the surface of the toner. The wax is at least one selected from A: ester wax that has an iodine value of not more than 25, a saponification value of 30 to 300, and an endothermic peak temperature (melting point) of 50° C. to 100° C. based on a DSC method, and B: wax that is obtained by the reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melted point) of 50° C. to 120° C. based on the DSC method.

A method for producing toner of the present invention includes the following: forming aggregated particles in an aqueous medium by mixing and aggregating (a) a first resin particle dispersion in which first resin particles are dispersed in a surface-active agent, (b) a colorant particle dispersion in which colorant particles are dispersed in a surface-active agent having the same polarity as that of the surface-active agent for the first resin particle dispersion, (c1) a wax particle dispersion in which at least ester wax that has an iodine value of not more than 25, a saponification value of 30 to 300, and an endothermic peak temperature (melting point) of 50° C. to 100° C. based on a DSC method is dispersed in a surface-active agent having the opposite polarity to that of the surface-active agent for the first resin particle dispersion, or (c2) a wax particle dispersion in which at least wax that is obtained by the reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melted point) of 50° C. to 120° C. based on the DSC method is dispersed in a surface-active agent having the opposite polarity to that of the surface-active agent for the first resin particle dispersion, and (d) a surface-active agent having the same polarity as that of the surface-active agent for the wax particle dispersion; forming melted particles by heating the aggregated particles for a predetermined time in the aqueous medium; mixing the melted particles with a second resin particle dispersion in which second resin particles are dispersed in a surface-active agent (e) so that the second resin particles adhere to the melted particles; and forming fused films of the second resin particles on the surfaces of the melted particles by heating.

A two-component developer of the present invention includes toner and a carrier. The toner includes aggregated particles including at least resin particles, pigment particles, and wax particles. A fused film of the resin is formed on the surface of the toner. The wax is at least one selected from A: ester wax that has an iodine value of not more than 25, a saponification value of 30 to 300, and an endothermic peak temperature (melting point) of 50° C. to 100° C. based on a DSC method, and B: wax that is obtained by the reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melted point) of 50° C. to 120° C. based on the DSC method. The carrier includes magnetic particles as a core material, and at least the surface of the core material is coated with a fluorine modified silicone resin containing an aminosilane coupling agent.

A first image forming method of the present invention includes the following: forming electrostatic latent images by using a plurality of toner image forming stations, each of which includes an image support member, a charging member for forming an electrostatic latent image on the image support member, and a toner support member; making the electrostatic latent images formed on the image support members visible by development with toner including aggregated particles that include at least resin particles, pigment particles, and wax particles, wherein a fused film of the resin is formed on the surface of the toner, and the wax is at least one selected from A: ester wax that has an iodine value of not more than 25, a saponification value of 30 to 300, and an endothermic peak temperature (melting point) of 50° C. to 100° C. based on a DSC method, and B: wax that is obtained by the reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melted point) of 50° C. to 120° C. based on the DSC method; and performing a transfer system that includes a primary transfer process and a secondary transfer process. In the primary transfer process, toner images obtained by the development of the electrostatic latent images are transferred to an endless transfer member that is in contact with each of the image support members. The primary transfer process is carried out continuously in sequence so that a multilayer toner image is formed on the transfer member. The secondary transfer process is carried out by collectively transferring the multilayer toner image from the transfer member to a transfer medium. The transfer system satisfies a relationship expressed by $d1/v \leqq 0.65$ (sec) where d1 (mm) is a distance between a first primary transfer position and a second primary transfer position, or between the second primary transfer position and a third primary transfer position, or between the third primary transfer position and a fourth primary transfer position, and v (mm/s) is a circumferential velocity of the image support member.

A second image forming method of the present invention includes the following: forming electrostatic latent images by using a plurality of toner image forming stations, each of which includes an image support member, a charging member for forming an electrostatic latent image on the image support member, and a toner support member; making the electrostatic latent images formed on the image support members visible by development with a two-component developer including toner and a carrier, the toner including aggregated particles that include at least resin particles, pigment particles, and wax particles, wherein the wax is at least one selected from A: ester wax that has an iodine value of not more than 25, a saponification value of 30 to 300, and an endothermic peak temperature (melting point) of 50° C. to 100° C. based on a DSC method; and B: wax that is obtained by the reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melted point) of 50° C. to 120° C. based on the DSC method, and the carrier includes magnetic particles as a core material, and at least the surface of the core material is coated with a fluorine modified silicone resin containing an aminosilane coupling agent; and performing a transfer system that includes a primary transfer process and a secondary transfer process. In the primary transfer process, toner images obtained by the development of the electrostatic latent images are transferred to an endless transfer member that is in contact with each of the image support members. The primary transfer process is carried out continuously in sequence so that a multilayer toner image is formed on the transfer member. The secondary transfer process is carried out by collectively transferring the multilayer toner image from the transfer member to a transfer medium. The transfer system satisfies a relationship expressed by $d1/v \leqq 0.65$ (sec) where d1 (mm) is a distance between a first primary transfer position and a second primary transfer position, or between the second primary transfer position and a third primary transfer position, or between the third primary transfer position and a fourth primary transfer position, and v (mm/s) is a circumferential velocity of the image support member.

BRIEF DESCRIPTION OF DRAWINGS

FIG. 5 is a schematic process chart showing a production method of

Figure 1:
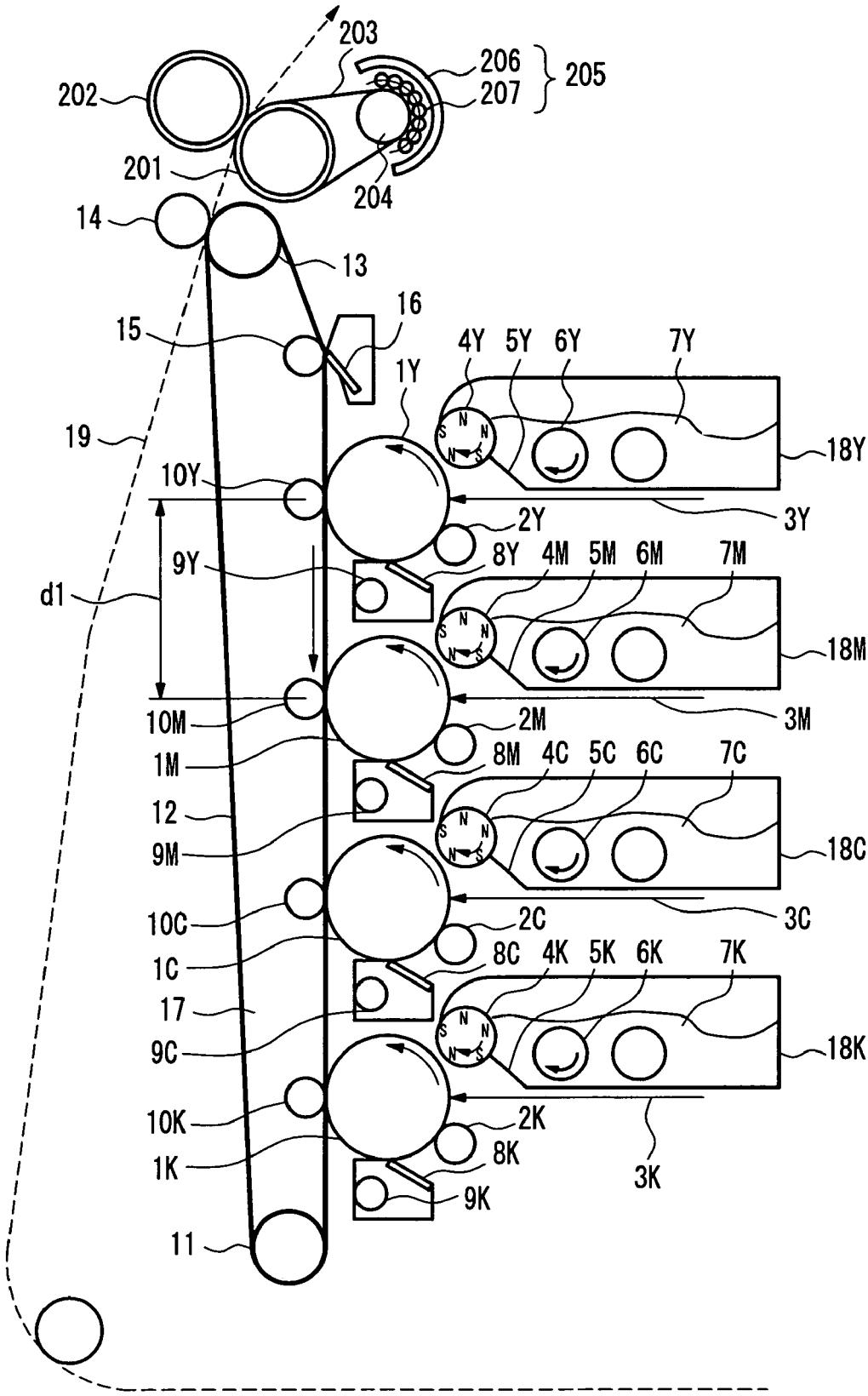
FIG. 1 is a cross-sectional view showing the configuration of an image forming apparatus used in an example of the present invention.

1: photoconductive member, 2: charging roller, 3: laser signal light, 4: developing roller, 5: blade, 10: first transfer roller, 12:

transfer belt, 14: second transfer roller, 13: driving tension roller, 17: transfer belt unit 18K, 18C, 18M, 18Y: image forming units, 18: image forming unit group, 20: emulsion polymerization tank, 30: pigment dispersion tank, 40: wax dispersion tank, 50: aggregation tank, 60: filtration separation tank, 70: washing tank, 201: fixing roller, 202: pressure roller, 203: fixing belt, 205: induction heater, 206: ferrite core, 207: coil

DESCRIPTION OF THE INVENTION

The present invention provides toner for electrostatic charge image development that has a smaller particle size and a sharp particle size distribution and that can exhibit high charging characteristics, environmental dependence, cleaning property, and transfer property, and a two-component developer. The present invention also provides an image forming method that can form color images with high quality and reliability without causing toner scattering, fog, or the like.

(1) Wax

The toner of the present invention includes wax. The wax is required not only to improve the anti-offset property of the toner in fixing, but also to satisfy the electrophotographic characteristics, e.g., by preventing fog or scattering during development as well as reverse transfer or transfer voids. In view of this, the present inventors studied various kinds of wax. For low molecular weight polyolefin wax of polyethylene or polypropylene, it was difficult to disperse the wax finely in the liquid to form a dispersion, and the amount of wax liberated became larger in an aggregation reaction. When the wax was used in color toner, it was difficult to produce a clear color image because the image was prone to a dull color. For fatty acid amide wax of oleic acid amide, erucic acid amide, or stearic acid amide, the wax was dispersed finely in the liquid to form a dispersion. However, reaggregation of the wax was likely to occur over time, and thus handling was a problem. For paraffin wax, microcrystalline wax, and Fischer-Tropsch wax, it was difficult to disperse the wax in the liquid to form a dispersion, and the amount of wax liberated became larger in an aggregation reaction.

As a result of the above study, the present inventors found wax that can be dispersed finely in the liquid to form a dispersion, causes no reaggregation over time, and is not liberated during an aggregation reaction. The present inventors also focused on the characteristics of the wax that do not impair the fixing, development, and transfer properties.

The wax added to the toner of the present invention preferably has an iodine value of not more than 25 and a saponification value of 30 to 300. The amount of wax added is preferably 1 to 20 parts by weight per 100 parts by weight of the binder resin. This wax can relieve the repulsion caused by the charging action of the toner during multilayer transfer and also can suppress a reduction in transfer efficiency, transfer voids, or reverse transfer. By combining the wax with a carrier, it is possible to suppress the occurrence of spent on the carrier. Accordingly, the life of a developer can be made longer. Further, the handling property of the toner in a developing unit can be improved, so that the image uniformity can be improved in both the start and end of the development. The generation of a developing memory also can be reduced. The wax can be mixed and aggregated uniformly with the resin particles and the pigment particles by a surface-active agent having a specific polarity, which will be described later. This can eliminate the suspended solids, thereby suppressing a dull color. In the subsequent process, the wax is not liberated easily while a resin is fused further.

The amount of wax added is preferably 5 to 20 parts by weight, and more preferably 10 to 20 parts by weight per 100 parts by weight of the binder resin. When it is less than 5 parts by weight, the effect of improving the fixability cannot be obtained. When it is more than 20 parts by weight, the storage stability is a problem.

When the iodine value of the wax is more than 25, the mixing and aggregation of the wax in the aqueous medium become poor, and uniform dispersibility is decreased to cause a dull color. Moreover, suspended solids are increased and remain in the toner, which may lead to filming of the toner on a photoconductive member or the like. This makes it difficult to relieve the repulsion caused by the charging action of the toner during multilayer transfer in the primary transfer process. The environmental dependence is large, and a change in chargeability of the material is increased to impair the image stability over a long period of continuous use. Further, a developing memory can be generated easily.

When the saponification value of the wax is less than 30, the presence of unsaponifiable matter and hydrocarbon is increased, resulting in filming of the toner on a photoconductive member or low chargeability. Moreover, the dispersibility of the wax with a charge control agent is decreased to cause filming or low chargeability of the toner during continuous use. When the saponification value is more than 300, the dispersibility of the wax with a resin is decreased, thus making it difficult to relieve the repulsion caused by the charging action of the toner during multilayer transfer. Moreover, fog or toner scattering may be increased.

The binder resin preferably has an acid value of 1 to 40 mgKOH/g. When the acid value is less than 1 mgKOH/g, it is difficult to relieve the repulsion caused by the charging action of the toner during multilayer transfer. When the acid value is more than 40 mgKOH/g, the environmental resistance is reduced to increase fog.

The melting point of the wax based on a DSC method is preferably 50° C. to 100° C. More preferably, the wax may have an iodine value of not more than 15, a saponification value of 50 to 250, and a melting point of 65° C. to 90° C. based on the DSC method. Further preferably, the wax may have an iodine value of not more than 5, a saponification value of 70 to 200, and a melting point of 65° C. to 85° C. based on the DSC method.

A preferred material for the wax may have a rate of volume increase of 2 to 30% when the temperature changes by 10° C. above the melting point. The wax expands rapidly upon changing from solid to liquid, so that when it is melted by heat during fixing, the toner particles adhere to each other more strongly. This further can improve the fixability, the releasing property for the fixing roller, and the offset resistance. When the rate of volume increase is smaller than 2%, these effects are reduced. When it is larger than 30%, the dispersibility is likely to be decreased during kneading.

The wax preferably has a heating loss of not more than 8 wt % at 220° C. When the heating loss is more than 8 wt %, the glass transition point of the toner becomes low, and the storage stability is degraded. Therefore, such wax adversely affects the development property and allows fog or filming of the toner on a photoconductive member to occur.

Among the molecular weight characteristics of the wax based on gel permeation chromatography (GPC), it is preferable that the number-average molecular weight is 100 to 5000, the weight-average molecular weight is 200 to 10000, the ratio (weight-average molecular weight/number-average molecular weight) of the weight-average molecular weight to the number-average molecular weight is 1.01 to 8, the ratio (Z average molecular weight/number-average molecular weight) of the Z average molecular weight to the number-average molecular weight is 1.02 to 10, and there is at least one molecular weight maximum peak in the range of $5\times10^2$ to $1\times10^4$. It is more preferable that the number-average molecular weight is 500 to 4500, the weight-average molecular weight is 600 to 9000, the weight-average molecular weight/number-average molecular weight ratio is 1.01 to 7, and the Z average molecular weight/number-average molecular weight ratio is 1.02 to 9. It is further preferable that the number-average molecular weight is 700 to 4000, the weight-average molecular weight is 800 to 8000, the weight-average molecular weight/number-average molecular weight ratio is 1.01 to 6, and the Z average molecular weight/number-average molecular weight ratio is 1.02 to 8.

When the number-average molecular weight is less than 100, the weight-average molecular weight is less than 200, and the molecular weight maximum peak is smaller than $5\times10^2$, the storage stability is likely to be degraded. Moreover, the handling property of the toner in a developing unit is reduced to impair the uniformity of the toner concentration. Further, the filming of the toner on a photoconductive member may occur.

When the number-average molecular weight is more than 5000, the weight-average molecular weight is more than 10000, the weight-average molecular weight/number-average molecular weight ratio is more than 8, the Z average molecular weight/number-average molecular weight ratio is more than 10, and the molecular weight maximum peak is in the range larger than $1\times10^4$, the releasing action is weakened, and the fixing functions such as fixability and offset resistance are likely to be degraded.

Preferred materials for the wax may be, e.g., meadowfoam oil, jojoba oil, Japan wax, beeswax, ozocerite, carnauba wax, candelilla wax, ceresin wax, rice wax, and derivatives thereof They can be used individually or in combinations of two or more. In particular, at least one selected from carnauba wax with a melting point of 76° C. to 90° C., candelilla wax with a melting point of 66° C. to 80° C., hydrogenated jojoba oil with a melting point of 64° C. to 78° C., hydrogenated meadowfoam oil with a melting point of 64° C. to 78° C., and rice wax with a melting point of 74° C. to 90° C. base on the DSC method also can be used preferably.

The saponification value is the milligrams of potassium hydroxide (KOH). required to saponify 1 g sample and corresponds to the sum of an acid value and an ester value. When the saponification value is measured, a sample is saponified with approximately 0.5N potassium hydroxide in an alcohol solution, and then excess potassium hydroxide is titrated with 0.5N hydrochloric acid.

The iodine value may be determined in the following manner. The amount of halogen absorbed by a sample is measured while the halogen acts on the sample. Then, the amount of halogen absorbed is converted to iodine and expressed in grams per 100 g of the sample. The iodine value is grams of iodine absorbed by 100 g fat, and the degree of unsaturation of fatty acid in the sample increases with the iodine value. A chloroform or carbon tetrachloride solution is prepared as a sample, and an alcohol solution of iodine and mercuric chloride or a glacial acetic acid solution of iodine chloride is added to the sample. After the sample is allowed to stand, the iodine that remains without causing any reaction is titrated with a sodium thiosulfate standard solution, thus calculating the amount of iodine absorbed.

The heating loss may be measured in the following manner. A sample cell is weighed precisely to the first decimal place (W1 mg). Then, 10 to 15 mg of sample is placed in the sample cell and weighed precisely to the first decimal place (W2 mg). This sample cell is set in a differential thermal balance and measured with a weighing sensitivity of 5 mg. After measurement, the weight loss (W3 mg) of the sample at 220° C. is read to the first decimal place using a chart. The measuring device is, e.g., TGD-3000 (manufactured by ULVAC-RICO, Inc.), the rate of temperature rise is 10° C./min, the maximum temperature is 220° C., and the retention time is 1 min. Accordingly, the heating loss (%) can be determined by $W3/(W2-W1)\times100$. Thus, the transmittance in color images and the offset resistance can be improved. Moreover, it is possible to suppress the occurrence of spent on a carrier and to increase the life of a developer.

The following wax also can be used preferably: wax obtained by the reaction of alkyl alcohol having a carbon number of 4 to 30, unsaturated polycarboxylic acid or its anhydride, and unsaturated hydrocarbon wax; wax obtained by the reaction of alkylamine, unsaturated polycarboxylic acid or its anhydride, and unsaturated hydrocarbon wax; or wax obtained by the reaction of fluoroalkyl alcohol, unsaturated polycarboxylic acid or its anhydride, and unsaturated hydrocarbon wax.

For the molecular weight distribution of this wax based on GPC, it is preferable that the weight-average molecular weight is 1000 to 6000, the Z average molecular weight is 1500 to 9000, the ratio (weight-average molecular weight/number-average molecular weight) of the weight-average molecular weight to the number-average molecular weight is 1.1 to 3.8, the ratio (Z average molecular weight/number-average molecular weight) of the Z average molecular weight to the number-average molecular weight is 1.5 to 6.5, there is at least one molecular weight maximum peak in the range of $1\times10^3$ to $3\times10^4$, the acid value is 1 to 80 mgKOH/g, the melting point is 50° C. to 120° C., and the penetration number is not more than 4 at 25° C. It is more preferable that the weight-average molecular weight is 1000 to 5000, the Z average molecular weight is 1700 to 8000, the weight-average molecular weight/number-average molecular weight ratio is 1.1 to 2.8, the Z average molecular weight/number-average molecular weight ratio is 1.5 to 4.5, there is at least one molecular weight maximum peak in the range of $1\times10^3$ to $1\times10^4$, the acid value is 10 to 70 mgKOH/g, and the melting point is 60° C. to 110° C. It is further preferable that the weight-average molecular weight is 1000 to 2500, the Z average molecular weight is 1900 to 3000, the weight-average molecular weight/number-average molecular weight ratio is 1.2 to 1.8, the Z average molecular weight/number-average molecular weight ratio is 1.7 to 2.5, there is at least one molecular weight maximum peak in the range of $1\times10^3$ to $3\times10^3$, the acid value is 35 to 50 mgKOH/g, and the melting point is 65° C. to 95° C. The wax with the above molecular weight distributions can contribute to higher offset resistance, glossiness, and OHP transmittance in the oilless fixing. Moreover, the wax does not decrease the storage stability at high temperatures. When an image is formed by arranging three layers of color toner on a thin paper, the wax is particularly effective to improve the separatability of the paper from the fixing roller or belt. The wax can be mixed and aggregated uniformly with the resin particles and the pigment particles. This can eliminate the suspended solids, thereby suppressing a dull color. When a resin further is fused with the particles, the liberation of the wax is not likely to occur, and the mixing and dispersing state can be produced easily. Even if a fluorine or silicone material is used for the fixing roller, offset of a halftone image can be suppressed.

By combining the wax with a carrier, which will be described later, it is possible not only to achieve the oilless fixing but also to suppress the occurrence of spent on the carrier. Accordingly, the service life of a developer can be made longer. While the uniformity of the toner in a developing unit can be maintained, the generation of a developing memory also can be reduced. Further, the charge stability can be maintained during continuous use, which ensures compatibility between the fixability and the development stability.

When the carbon number of the alkyl group of the wax is less than 4, the releasing action is weakened, so that the separatability and the high-temperature offset resistance are degraded. When the carbon number is more than 30, the mixing and aggregation of the wax with the resin particles become poor, resulting in low dispersibility. When the acid value is less than 1 mgKOH/g, the amount of charge of the toner is reduced over a long period of use. When the acid value is more than 80 mgKOH/g, the moisture resistance is decreased to increase fog under high humidity.

When the melting point is less than 50° C., the storage stability of the toner is degraded. When it is more than 120° C., the releasing action is weakened, and the temperature range of offset resistance is narrowed. Moreover, it is difficult to reduce the particle size of the emulsified and dispersed particles of the wax.

When the penetration number is more than 4 at 25° C., the toughness is reduced to cause filming of the toner on a photoconductive member over a long period of use.

When the weight-average molecular weight is less than 1000, the Z average molecular weight is less than 1500, the weight-average molecular weight/number-average molecular weight ratio is less than 1.1, the Z average molecular weight/number-average molecular weight ratio is less than 1.5, and the molecular weight maximum peak is in the range smaller than $1\times10^3$, the storage stability of the toner is degraded, thus causing filming of the toner on a photoconductive member or intermediate transfer member. Moreover, the handling property of the toner in a developing unit is reduced to impair the uniformity of the toner concentration. Further, a developing memory can be generated easily. Thus, when emulsified and dispersed particles are produced under the strong shearing force of a high-speed rotating body, the particle size distribution becomes broader.

When the weight-average molecular weight is more than 6000, the Z average molecular weight is more than 9000, the weight-average molecular weight/number-average molecular weight ratio is more than 3.8, the Z average molecular weight/number-average molecular weight ratio is more than 6.5, and the molecular weight maximum peak is in the range larger than $3\times10^4$, the releasing action is weakened, and the fixing functions are degraded. Moreover, it is difficult to reduce the particle size of the emulsified and dispersed particles of the wax, and the mixing and dispersing state cannot be produced easily.

Examples of the alcohol include alcohols having an alkyl chain with a carbon number of 4 to 30 such as octanol ($C_8H_{17}OH$), dodecanol ($C_{12}H_{25}OH$), stearyl alcohol ($C_{18}H_{37}OH$), nonacosanol ($C_{29}H_{59}OH$), and pentadecanol ($C_{15}H_{31}OH$). Examples of the amines include N-methylhexylamine, nonylamine, stearylamine, and nonadecylamine. Examples of the fluoroalkyl alcohol include 1-methoxy-(perfluoro-2-methyl-1-propene), hexafluoroacetone, 3-perfluorooctyl-1, and 2-epoxypropane. Examples of the unsaturated polycarboxylic acid or its anhydride include maleic acid, maleic anhydride, itaconic acid, itaconic anhydride, citraconic acid, and citraconic anhydride. They can be used individually or in combinations of two or more. In particular, the maleic acid and the maleic anhydride are preferred. Examples of the unsaturated hydrocarbon wax include ethylene, propylene, and α-olefin.

The unsaturated polycarboxylic acid or its anhydride is polymerized using alcohol or amine, and then is added to a synthetic hydrocarbon wax in the presence of dicumyl peroxide or tert-butylperoxy isopropyl monocarbonate.

The amount of wax added is preferably 1 to 20 parts by weight per 100 parts by weight of the binder resin. When it is less than 1 part by weight, the releasing effect cannot be obtained easily. When it is more than 20 parts by weight, the flowability of the toner is decreased, and the effect is no longer improved due to saturation.

A wax particle dispersion is prepared by heating and melting wax in distilled water, adding a surface-active agent having a polarity to the wax melt, and dispersing the wax with a dispersing means. When the wax has a high melting point, it may be melted by heating under high pressure so as to form a dispersion.

The above wax has a specific polar group. Therefore, it is preferable that lauryl amine hydrochloride or stearic acid amine hydrochloride is used as a cationic surface-active agent. This allows the dispersion to be finer. Moreover, when the aggregated particles are formed by an aggregation reaction, less wax is liberated, so that a uniform narrow particle size distribution can be achieved. In such a case, water-soluble polymer components such as polyvinyl alcohol or water-soluble cellulose may be added simultaneously with the lauryl amine hydrochloride or stearic acid amine hydrochloride, thereby improving the dispersion stability.

As the dispersing means, e.g., a homogenizer can be used to produce a dispersion with a median diameter of 0.2 to 0.3 μm. However, a finer dispersion with a median diameter of not more than 0.2 μm can be obtained in such a manner that the wax melt is emulsified and dispersed by utilizing the effect of a strong shearing force generated when a rotating body rotates at high speed relative to a fixed body with a predetermined gap (about 0.1 mm to 10 mm) between them. The rotating body rotates at a high speed of not less than 30 m/s, and preferably not less than 40 m/s and exerts a strong shearing force on the liquid, thus producing an emulsified dispersion with a finer particle size. A 30-second to 5-minute treatment may be enough to obtain the fine dispersion.

Figure 3:
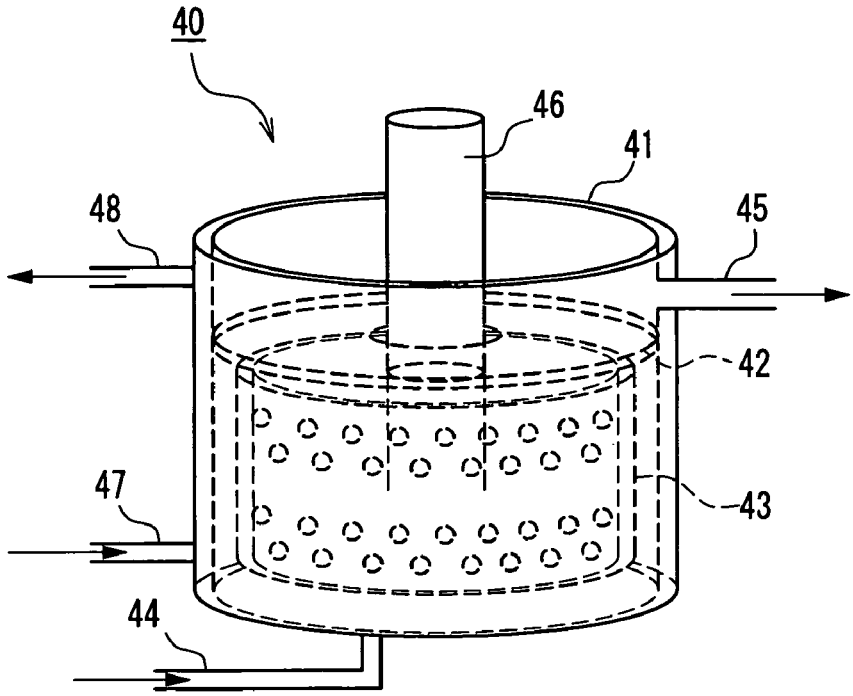
FIG. 3 is a schematic perspective view of a wax dispersing device in an embodiment of the present invention.
Figure 4:
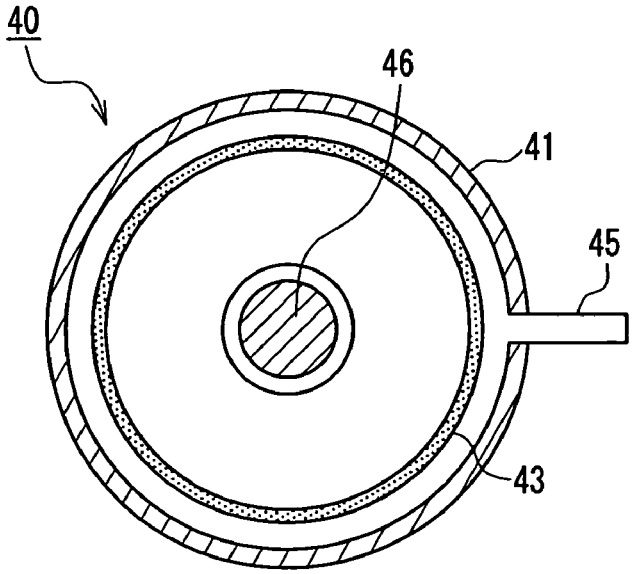
FIG. 4 is a plan view of the wax dispersing device in FIG. 3.

FIG. 3 is a schematic perspective view of a stirring/dispersing device 40 for wax in an embodiment of the present invention. FIG. 4 is a plan view of the stirring/dispersing device 40. This device is water cooling jacket type. The whole device is cooled by introducing cooling water from a line 47 to the inside of an outer tank 41 and discharging it through a line 48. Reference numeral 42 is a shielding board that stops the liquid to be treated flowing. The shielding board 42 has an opening in the central portion, and the treated liquid is drawn from the opening and taken out of the device through a line 45. Reference numeral 43 is a rotating body that is secured to a shaft 46 and rotates at high speed. There are holes (about 1 to 5 mm in size) in the side of the rotating body 43, and the liquid to be treated can move through the holes. The liquid to be treated is put into the tank in an amount of about one-half the capacity (120 ml) of the tank. The maximum rotational speed of the rotating body can be 50 m/s. The rotating body has a diameter of 52 mm, and the tank has an internal diameter of 56 mm. Reference numeral 44 is a material inlet used for a continuous treatment. In the case of a high-pressure treatment or batch treatment, the material inlet 44 is closed.

(2) Resin

As the resin particles of the toner of this embodiment, e.g., a thermoplastic binder resin can be used. Specific examples of the thermoplastic binder resin include the following: styrenes such as styrene, parachloro styrene, and α-methyl styrene; acrylic monomers such as methyl acrylate, ethyl acrylate, n-propyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylene-unsaturated acid monomers such as acrylic acid, methacrylic acid, and sodium styrenesulfonate; vinyl nitrites such as acrylonitrile and methacrylonitrile; vinyl ethers such as vinyl methylether and vinyl isobutylether; vinyl ketones such as vinyl methylketone, vinyl ethylketone, and vinyl isopropenylketone; and olefins such as ethylene, propylene, and butadiene, and a homopolymer, a copolymer, or a mixture of these substances (monomers). The specific examples further may include a non-vinyl condensed resin such an epoxy resin, a polyester resin, a polyurethane resin, a polyamide resin, a cellulose resin, or a polyether resin, a mixture of the non-vinyl condensed resin and any of the vinyl resins as described above, and a graft copolymer formed by polymerization of vinyl monomers in the presence of the non-vinyl condensed resin.

Among these resins, the vinyl resin is preferred particularly. The vinyl resin is advantageous in that a resin particle dispersion can be prepared easily, e.g., by emulsion polymerization or seed polymerization using an ionic surface-active agent. Examples of the vinyl monomer include a monomer to be used as a material for a vinyl polymer acid or a vinyl polymer base, such as acrylic acid, methacrylic acid, maleic acid, cinnamic acid, fumaric acid, vinyl sulfonic acid, ethylene imine, vinyl pyridine, or vinyl amine. In the present invention, the resin particles preferably contain the vinyl monomer as a monomer component. In the present invention, the vinyl polymer acid is more preferred among the vinyl monomers in view of ease of the vinyl resin formation reaction. Specifically, a dissociating vinyl monomer having a carboxyl group as a dissociation group such as acrylic acid, methacrylic acid, maleic acid, cinnamic acid, or fumaric acid is preferred particularly in terms of controlling the polymerization degree or the glass transition point.

The median diameter of the resin particles is generally not more than 1 μm, and preferably 0.01 to 1 μm. When the median diameter is more than 1 μm, toner for electrostatic charge image development to be obtained as a final product can have a broader particle size distribution. Moreover, liberated particles are generated and tend to reduce the performance or reliability. When the median diameter is within the above range, these disadvantages are eliminated, and the uneven distribution of toner is decreased. Therefore, the dispersion of the resin particles in the toner can be improved, resulting in a smaller variation in performance and reliability. The median diameter can be measured, e.g., by a laser diffraction particle size analyzer (LA 920 manufactured by Horiba, Ltd.).

The content of resin particles in the resin particle dispersion is generally 5 to 60 wt %, and preferably 10 to 40 wt %. When the aggregated particles are formed, the content of resin particles in the aggregated particle dispersion may be not more than 50 wt %, and preferably about 2 to 40 wt %.

The molecular weights of the resin, wax, and toner can be measured by gel permeation chromatography (GPC) using several types of monodisperse polystyrene as a standard sample. The measurement may be performed with HPLC 8120 series manufactured by TOSOH CORP., using TSK gel super HM-H H4000/H3000/H2000 (7.8 mm diameter, 150 mm×3) as a column and THF (tetrahydrofuran) as an eluent, at a flow rate of 0.6 ml/min, a sample concentration of 0.1%, an injection amount of 20 μL, RI as a detector, and at a temperature of 40° C. Prior to the measurement, the sample is dissolved in THF, and then is filtered through a 0.45 μm filter so that additives such as silica are removed to measure the resin component. The measurement requirement is that the molecular weight distribution of the subject sample is in the range where the logarithms and the count numbers of the molecular weights in the analytical curve obtained from the several types of monodisperse polystyrene standard samples form a straight line.

The wax obtained by the reaction of alkyl alcohol having a carbon number of 4 to 30, unsaturated polycarboxylic acid or its anhydride, and unsaturated hydrocarbon wax can be measured with GPC-150C (manufactured by Waters Corporation), using Shodex HT-806M (8.0 mm I.D.–30 cm×2) as a column and o-dichlorobenzene as an eluent, at a flow rate of 1.0 mL/min, a sample concentration of 0.3%, an injection amount of 200 μL, RI as a detector, and at a temperature of 130° C. Prior to the measurement, the sample is dissolved in a solvent, and then is filtered through a 0.5 μm sintered metal filter. The measurement requirement is that the molecular weight distribution of the subject sample is in the range where the logarithms and the count numbers of the molecular weights in the analytical curve obtained from the several types of monodisperse polystyrene standard samples form a straight line.

The softening point of the binder resin can be measured with a capillary rheometer flow tester (CFT-500, constant-pressure extrusion system, manufactured by Shimadzu Corporation). A load of about $9.8\times10^5$ N/m$^2$ is applied to a 1 cm$^3$ sample with a plunger while heating the sample at a temperature increase rate of 6° C./min, so that the sample is extruded from a die having a diameter of 1 mm and a length of 1 mm. Based on the relationship between the piston stroke of the plunger and the temperature increase characteristics, when the temperature at which the piston stroke starts to rise is a flow start temperature (Tfb), one-half the difference between the minimum value of a curve and the flow end point is determined. Then, the resultant value and the minimum value of the curve are added to define a point, and the temperature of this point is identified as a melting point (softening point Tm) according to a ½ method.

The glass transition point of the resin can be measured with a differential scanning calorimeter. The temperature of a sample is raised to 100° C., retained for 3 minutes, and reduced to room temperature at 10° C./min. Subsequently, the temperature is raised at 10° C./min, and a thermal history of the sample is measured. In the thermal history, an intersection point of an extension line of the base line lower than a glass transition point and a tangent that shows the maximum inclination between the rising point and the highest point of a peak is determined. The temperature of this intersection point is identified as a glass transition point.

The melting point at an endothermic peak based on the DSC method can be measured with a differential scanning calorimeter (DSC-50 manufactured by Shimadzu Corporation). The temperature of a sample is raised to 200° C. at 5° C./min, retained for 5 minutes, and reduced to 10° C. rapidly. Subsequently, the sample is allowed to stand for 15 minutes, and the temperature is raised at 5° C./min. Then, the melting point is determined from the endothermic (melt) peak. The amount of the sample placed in a cell is 10 mg±2 mg.

(3) Polymerization Process

A resin particle dispersion is prepared by forming resin particles of a homopolymer or copolymer (vinyl resin) of vinyl monomers by emulsion or seed polymerization of the vinyl monomers in an ionic surface-active agent and dispersing the resin particles in the ionic surface-active agent. Any known dispersing devices such as a rotating and shearing homogenizer, a ball mill using a medium, a sand mill, and a Dyno mill can be used. When the resin particles are made of resin other than the homopolymer or copolymer of the vinyl monomers, a resin particle dispersion may be prepared in the following manner. If the resin dissolves in an oil solvent that has relatively low water solubility, a solution is obtained by mixing the resin with the oil solvent. The solution is blended with an ionic surface-active agent or polyelectrolyte, and then is dispersed in water to produce a fine particle dispersion by using a dispersing device such as a homogenizer. Subsequently, the oil solvent is evaporated by heating or under reduced pressure. Thus, the resin particles made of resin other than the vinyl resin are dispersed in the ionic surface-active agent. As a polymerization initiator, e.g., an azo- or diazo-based initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or azobisisobutyronitrile can be used.

A colorant particle dispersion is prepared by dispersing colorant particles in an ionic surface-active agent using a dispersing device such as a homogenizer.

A wax particle dispersion can be produced by the method as described above. The wax particle dispersion also can be produced in the following manner. The wax is dissolved in an oil solvent. This solution is blended with an ionic surface-active agent or polyelectrolyte, and then is dispersed in water to produce a fine particle dispersion by using a dispersing device such as a homogenizer. Subsequently, the oil solvent is evaporated by heating or under reduced pressure.

The colorant particle dispersion may be prepared by dispersing the colorant particles in a surface-active agent having a polarity using the above dispersing device.

The wax particle dispersion may be prepared by heating and melting the wax in distilled water, adding a surface-active agent having a polarity to the wax melt, and dispersing the wax with the above dispersing device. When the wax has a high melting point, it may be melted by heating under high pressure so as to form a dispersion. Alternatively, the wax is dissolved in an oil solvent. This solution is blended with an ionic surface-active agent or polyelectrolyte, and then is dispersed in water to produce a fine particle dispersion by using the dispersing device such as a homogenizer. Subsequently, the oil solvent is evaporated by heating or under reduced pressure.

In a process of mixing and aggregating these dispersions, aggregated particles including the first resin particles, the colorant particles, and the wax particles are formed in water. In this case, the polarity of a surface-active agent contained in the first resin particle dispersion is the same as that of a surface-active agent contained in the colorant particle dispersion. The polarity of a surface-active agent contained in the wax particle dispersion is opposite to that of a surface-active agent used for the resin and the colorant.

Moreover, a surface-active agent having the opposite polarity to that of a surface-active agent used for the resin and the colorant further is added separately. This allows the wax having a polarity such as an acid value, an alkyl group, or an iodine value to be mixed and aggregated uniformly with the resin and the colorant that have a polar group with a predetermined acid value. Therefore, it is possible to reduce the amount of wax or colorant that is not aggregated and thus is suspended in the aqueous medium, and to form aggregated particles having a sharp particle size. The mixing can be performed by using any known devices such as a homogenizer and a mixer.

Thereafter, the aggregated particles are heated for a predetermined time while mixing and stirring in the aqueous medium to form melted particles. The heating temperature preferably is not less than a glass transition point of the resin and is less than a temperature 20° C. higher than the glass transition point.

In the above process of mixing and aggregating the dispersions, aggregation may be caused by the addition of an aggregating agent or pH adjustment. However, when the specific wax is used, the particles are not aggregated stably and are likely to remain suspended in the aqueous medium.

When the melted particles are formed by heating the aggregated particles for a predetermined time in the aqueous medium, a second resin further adheres to the melted particles and serves as a coating. In this case, an inorganic salt may be added and fused to make the coating uniform.

The melted particles are controlled to have a volume average particle size that is about the same as or slightly smaller than the volume average particle size of toner to be obtained as a final product. The particles size can be set or changed depending on the amount of surface-active agent added, agitating speed, treatment, or temperature. Moreover, the toner can be varied from irregular to spherical in shape. The toner shape becomes closer to a sphere by heating at high temperatures for a long time.

It is preferable that the dispersion average particle size of the wax particles is 0.05 to 0.3 μm, the particles of not more than 0.2 μm are 65% by number or more, and the particles of more than 0.5 μm are 10% by number or less.

When the dispersion average particle size is smaller than 0.05 μm, the load is increased during dispersion, resulting in low productivity. When the particles of more than 0.5 μm are larger than 10% by number, and the particles of less than 0.2 μm are smaller than 65% by number, uniform dispersion cannot be achieved during mixing and aggregation, and more wax is liberated while the second resin is fused with the melted particles. Thus, the toner may increase filming on a photoconductive member or spent on a carrier and decrease the handling property in development. Moreover, a developing memory may be generated.

A second resin particle dispersion in which the second resin particles are dispersed is mixed with the melted particle dispersion so that the second resin particles adhere to the melted particles. The surface-active agent of the second resin particle dispersion has the same polarity as that of the first resin particle dispersion used in forming the aggregated particles. In this case, an inorganic metal salt is added as an aggregating agent to accelerate the adhesion of the second resin particles, and thus the production rate can be increased. The pH is adjusted preferably in the range of 7 to 10. The second resin particles can be fused with the melted particles without causing secondary aggregation of the melted particles.

Examples of the inorganic metal salt include polyaluminium hydroxide, magnesium sulfate, magnesium chloride, zinc sulfate, ferric chloride, aluminium chloride, and polyaluminium chloride. Among these, the polyvalent metal salts are preferred. In particular, the aluminium compounds are preferred. They can be used individually or in combinations of two or more. The addition of the inorganic metal salt can suppress the generation of very small particles and ensure a sharp particle size distribution of the toner to be produced.

It is preferable that when the second resin particles adhere to the melted particles, the temperature of the aqueous medium is not more than a glass transition point of the first resin particles included in the melted particles, and the particles are treated for 30 minutes to 2 hours while stirring gently with a mixer or the like. This can facilitate the adhesion between the melted particles and the second resin particles, so that the resultant particles are stabilized easily.

After the second resin particles adhere to the melted particles, heating is performed for 30 minutes to 3 hours at temperatures ranging from a glass transition point of the second resin particles that have adhered to the melted particles in the aqueous medium to the glass transition point +40° C. Consequently, the second resin particles are fused with the melted particles to form fused films firmly on the surfaces of the melted particles. By covering the surfaces of the melted particles with the second resin particles, it is possible to prevent the colorant or wax from being exposed on the toner surface. Thus, a charge failure or nonuniform charge due to the exposure can be suppressed effectively.

Thereafter, cleaning, liquid-solid separation, and drying processes may be performed as desired to provide toner. The cleaning process preferably involves sufficient substitution cleaning with ion-exchanged water to improve the chargeability. The liquid-solid separation process is not particularly limited, and any known filtration methods such as suction filtration and pressure filtration can be used preferably in view of productivity. The drying process is not particularly limited, and any known drying methods such as flash-jet drying, flow drying, and vibration-type flow drying can be used preferably in view of productivity.

As the surface-active agent having a polarity, e.g., an aqueous medium including a polar surface-active agent may be used. Examples of the aqueous medium include water such as distilled water or ion-exchanged water, and alcohols. They can be used individually or in combinations of two or more. The content of the polar surface-active agent in the surface-active agent having a polarity cannot be defined generally and may be selected appropriately depending on the purposes.

As the polar surface-active agent, e.g., a sulfate-based, sulfonate-based, phosphate-based, or soap-based anionic surface-active agent or an amine salt-type or quaternary ammonium salt-type cationic surface-active agent may be used.

Specific examples of the anionic surface-active agent include sodium dodecyl benzene sulfonate, sodium dodecyl sulfate, sodium alkyl naphthalene sulfonate, and sodium dialkyl sulfosuccinate. Specific examples of the cationic surface-active agent include alkyl benzene dimethyl ammonium chloride, alkyl trimethyl ammonium chloride, and distearyl ammonium chloride. They can be used individually or in combinations of two or more.

In the present invention, these polar surface-active agents can be used together with a nonpolar surface-active agent. As the nonpolar surface-active agent, e.g., a polyethylene glycol-based, alkylphenol ethylene oxide adduct-based, or polyhydric alcohol-based nonionic surface-active agent may be used.

(4) Charge Control Agent

As the charge control agent, e.g., particles of a triphenylmethane dye or dye including a complex of quarternary ammonium salt compound, nigrosine compound, aluminum, iron, or chromium can be used. The charge control agent also may be an acrylic/sulfonic acid polymer, and preferably a vinyl copolymer of a styrene monomer and an acrylic acid monomer having a sulfonic group as a polar group. In particular, an acrylamide-2-methylpropane sulfonic acid copolymer can provide favorable characteristics. By combining the charge control agent with the carrier, the handling property of the toner in a developing unit can be improved, thus increasing the uniformity of the toner concentration. Moreover, the generation of a developing memory can be reduced.

Preferred materials for the charge control agent may include a metal salt of a salicylic acid derivative expressed by Formula (1) and a metal salt of a benzilic acid derivative expressed by Formula (2).

Formula (1):

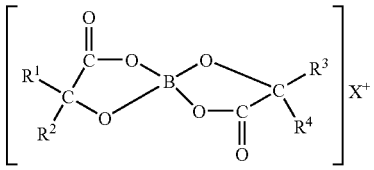

(where $R^1$ and $R^4$ independently represent a hydrogen atom, a straight-chain or branched alkyl group having a carbon number of 1 to 10, or an aromatic ring that may have a substituent, $R^2$ and $R^3$ are aromatic rings that may be substituted, and X is alkali metal).

Formula (2):

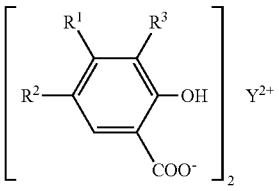

(where $R^1$, $R^2$, and $R^3$ independently represent a hydrogen atom, a straight-chain or branched alkyl group having a carbon number of 1 to 10, or a straight-chain or branched allyl group having a carbon number of 1 to 10, and Y is at least one selected from zinc, nickel, cobalt, copper, and chromium).

These materials can suppress the disturbance of an image caused by the charging action during fixing. Such a feature is attributed to the effect of the charge polarity of the functional group having an acid value of the wax and the metal salt. Moreover, it is possible to prevent a decrease in charge amount during continuous use.

The amount of charge control agent added is preferably 0.5 to 5 parts by weight, more preferably 1 to 4 parts by weight, and further preferably 3 to 4 parts by weight per 100 parts by weight of the binder resin. When it is less than 0.5 parts by weight, the effect of charging action is lost. When it is more than 5 parts by weight, color images are prone to have a dull color.

(5) Pigment

The colorant used in this embodiment may include, e.g., carbon black, iron black, graphite, nigrosine, a metal complex of azo dyes, acetoacetic acid aryl amide monoazo yellow pigments such as C. I. Pigment Yellow 1, 3, 74, 97, and 98, acetoacetic acid aryl amide disazo yellow pigments such as C. I. Pigment Yellow 12, 13, 14, and 17, C. I. Solvent Yellow 19, 77, and 79, or C. I. Disperse Yellow 164. In particular, benzimidazolone pigments of C. I. Pigment Yellow 93, 180, and 185 are effective for avoiding filming of the toner on a photoconductive member.

At least one selected from red pigments such as C. I. Pigment Red 48, 49:1, 53:1, 57, 57:1, 81, 122, and 5, red dyes such as C. I. Solvent Red 49, 52, 58, and 8, and blue dyes/pigments of phthalocyanine and its derivative such as C. I. Pigment Blue 15:3 may be added. The added amount is preferably 3 to 8 parts by weight per 100 parts by weight of the binder resin.

The median diameter of the pigment particles is generally not more than 1 μm, and preferably 0.01 to 1 μm. When the median diameter is more than 1 μm, toner for electrostatic charge image development to be obtained as a final product can have a broader particle size distribution. Moreover, liberated particles are generated and tend to reduce the performance or reliability. When the median diameter is within the above range, these disadvantages are eliminated, and the uneven distribution of toner is decreased. Therefore, the dispersion of the pigment particles in the toner can be improved, resulting in a smaller variation in performance and reliability. The median diameter can be measured, e.g., by a laser diffraction particle size analyzer (LA 920 manufactured by Horiba, Ltd.).

(6) Additive

In this embodiment, the additive may be, e.g., metal oxide fine powder such as silica, alumina, titanium oxide, zirconia, magnesia, ferrite, and magnetite, titanate such as barium titanate, calcium titanate, and strontium titanate, zirconate such as barium zirconate, calcium zirconate, and strontium zirconate, or a mixture of these substances. The additive can be made hydrophobic as needed.

A preferred silicone oil material that is used to treat silica is expressed by Formula (3).

Formula (3):

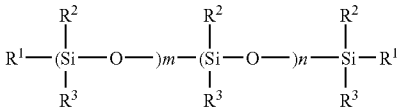

(where $R^2$ is an alkyl group having a carbon number of 1 to 3, $R^3$ is an alkyl group having a carbon number of 1 to 3, a halogen modified alkyl group, a phenyl group, or a substituted phenyl group, $R^1$ is an alkyl group having a carbon number of 1 to 3 or an alkoxy group having a carbon number of 1 to 3, and m and n are integers of 1 to 100).

Examples of the silicone oil material include dimethyl silicone oil, methyl hydrogen silicone oil, methyl phenyl silicone oil, cyclic dimethyl silicone oil, epoxy modified silicone oil, carboxyl modified silicone oil, carbinol modified silicone oil, methacrylic modified silicone oil, mercapto modified silicone oil, polyether modified silicone oil, methyl styryl modified silicone oil, alkyl modified silicone oil, fluorine modified silicone oil, amino modified silicone oil, and chlorophenyl modified silicone oil. The silica that is treated with at least one of the above silicone oil materials is used preferably. For example, SH200, SH510, SF230, SH203, BY16-823, or BY16-855B manufactured by Toray-Dow Corning Co., Ltd can be used. The treatment may be performed by mixing inorganic fine powder with the silicone oil material using a mixer (e.g., a Henshel mixer). Moreover, the silicone oil material may be spayed onto silica. Alternatively, the silicone oil material may be dissolved or dispersed in a solvent, and mixed with silica fine powder, followed by removal of the solvent. The amount of silicone oil material is preferably 1 to 20 parts by weight per 100 parts by weight of the inorganic fine powder.

Examples of a silane coupling agent include dimethyldichlorosilane, trimethylchlorosilane, allyldimethylchlorosilane, hexamethyldisilazane, allylphenyldichlorosilane, benzyl methyl chlorosilane, vinyltriethoxysilane, γ-methacryloxypropyltrimethoxysilane, vinyltriacetoxysilane, divinylchlorosilane, and dimethylvinylchlorosilane. The silane coupling agent may be treated by a dry treatment in which the fine powder is fluidized by agitation or the like, and an evaporated silane coupling agent is reacted with the fluidized powder, or a wet treatment in which a silane coupling agent dispersed in a solvent is added dropwise to the fine powder.

It is also preferable that the silicone oil material is treated after a silane coupling treatment.

The inorganic fine powder having positive chargeability may be treated with aminosilane, amino modified silicone oil expressed by Formula (4), or epoxy modified silicone oil.

Formula (4):

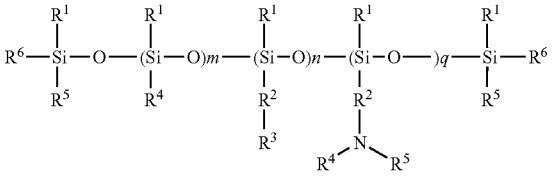

(where $R^1$ and $R^6$ are hydrogen, an alkyl group having a carbon number of 1 to 3, an alkoxy group, or an aryl group, $R^2$ is an alkylene group having a carbon number of 1 to 3 or a phenylene group, $R^3$ is an organic group including a nitrogen heterocyclic ring, $R^4$ and $R^5$ are hydrogen, an alkyl group having a carbon number of 1 to 3, or an aryl group, m is positive numbers of not less than 1, n and q are positive integers including 0, and n+1 is positive numbers of not less than 1).

To enhance a hydrophobic treatment, hexamethyldisilazane, dimethyldichlorosilane, or other silicone oil also can be used along with the above materials. For example, at least one selected from dimethyl silicone oil, methylphenyl silicone oil, and alkyl modified silicone oil is preferred to treat the inorganic fine powder.

Fatty acid ester, fatty acid amide, and a fatty acid metal salt also can be used to treat the surface of the inorganic fine powder, and silica or titanium oxide fine powder whose surface is treated with at lease one of these materials is more preferred.

Examples of the fatty acid and the fatty acid metal salt include caprylic acid, capric acid, undecylic acid, lauric acid, myristic acid, palmitic acid, stearic acid, behenic acid, montanic acid, lacceric acid, oleic acid, erucic acid, sorbic acid, and linoleic acid. In particular, fatty acid having a carbon number of 15 to 20 is preferred.

Preferred metals of the fatty acid metal salt may be, e.g., aluminum, zinc, calcium, magnesium, lithium, sodium, lead, or barium. Among these metals, aluminum, zinc, and sodium are more preferred. Further, mono- and di-fatty acid aluminum such as aluminum distearate ($Al(OH)(C_{17}H_{35}COO)_2$) or aluminum monostearate ($Al(OH)_2(C_{17}H_{35}COO)$) are particularly preferred. By containing a hydroxy group, they can prevent overcharge and suppress a transfer failure. Moreover, it is possible to improve the treatment of the inorganic fine powder such as silica.

The handling property of toner with a small particle size can be improved, and therefore high image quality and high transfer performance can be achieved in the development and transfer processes. Thus, an electrostatic latent image can be developed more faithfully and transferred without reducing a transfer ratio of the toner particles. In the case of tandem transfer, it is also possible to prevent retransfer and to suppress transfer voids. Moreover, high image density can be achieved even with a small amount of development. By combining the additive with a carrier, which will be described later, higher resistance to spent can be obtained, and the handling property of the toner in a developing unit can be improved, thus increasing the uniformity of the toner concentration. The generation of a developing memory also can be reduced.

It is preferable that 1.5 to 5.5 parts by weight of the inorganic fine powder having an average particle size of 6 nm to 200 nm is added to 100 parts by weight of toner base particles. When the average particle size is less than 6 nm, suspended silica particles are generated, and filming of the toner on a photoconductive member is likely to occur. Therefore, it is difficult to avoid the occurrence of reverse transfer. When the average particle size is more than 200 nm, the flowability of the toner is decreased. When the amount of inorganic fine powder added is less than 1.5 parts by weight, the flowability of the toner is decreased, and it is difficult to avoid the occurrence of reverse transfer. When it is more than 5.5 parts by weight, suspended silica particles are generated, and filming of the toner on a photoconductive member is likely to occur, thus degrading the high-temperature offset resistance.

Moreover, it is preferable that 0.5 to 2.5 parts by weight of the inorganic fine powder having an average particle size of 6 nm to 20 nm and 1.0 to 3.5 parts by weight of the inorganic fine powder having an average particle size of 30 nm to 200 nm are added to 100 parts by weight of toner base particles. With this configuration, silica can have different functions to ensure larger margins for the handling property of the toner in development, reverse transfer, transfer voids, and scattering during transfer. It is also possible to prevent spent on a carrier.

In this case, the ignition loss of the inorganic fine powder having an average particle size of 6 nm to 20 nm is preferably 1.5 to 25 wt %, and the ignition loss of the inorganic fine powder having an average particle size of 30 nm to 200 nm is preferably 0.5 to 23 wt %.

By specifying the ignition loss of silica, larger margins can be ensured against reverse transfer, transfer voids, and scattering during transfer. When the silica is combined with the carrier or wax, higher resistance to spent can be obtained, and the handling property of the toner in a developing unit can be improved, thus increasing the uniformity of the toner concentration. The generation of a developing memory also can be reduced.

When the ignition loss of the inorganic fine powder having an average particle size of 6 nm to 20 nm is less than 1.5 wt %, the margins against reverse transfer and transfer voids become narrow. When the ignition loss is more than 25 wt %, the surface treatment is not uniform, resulting in charge variations. The ignition loss is preferably 1.5 to 20 wt %, and more preferably 5 to 19 wt %.

When the ignition loss of the inorganic fine powder having an average particle size of 30 nm to 200 nm is less than 0.5 wt %, the margins against reverse transfer and transfer voids become narrow. When the ignition loss is more than 23 wt %, the surface treatment is not uniform, resulting in charge variations. The ignition loss is preferably 1.5 to 18 wt %, and more preferably 5 to 16 wt %.

It is also preferable that 0.5 to 1.5 parts by weight of positively charged inorganic fine powder having an average particle size of 6 nm to 200 nm and an ignition loss of 0.5 to 25 wt % further is added to 100 parts by weight of toner base particles.

The addition of the positively charged inorganic fine powder can suppress the overcharge of the toner for a long period of continuous use and increase the life of a developer. Therefore, the scattering of the toner during transfer caused by overcharge also can be reduced. Moreover, it is possible to prevent spent on a carrier. When the amount of positively charged inorganic fine powder added is less than 0.5 parts by weight, these effects are not likely to be obtained. When it is more than 1.5 parts by weight, fog is increased significantly during development. The ignition loss is preferably 1.5 to 20 wt %, and more preferably 5 to 19 wt %.

A drying loss (%) can be determined in the following manner. A container is dried, allowed to stand and cool, and weighed precisely beforehand. Then, a sample (about 1 g) is put in the container, weighed precisely, and dried for 2 hours with a hot-air dryer at 105° C.±1° C. After cooling for 30 minutes in a desiccator, the weight is measured, and the drying loss is calculated by $$\text{Drying loss (\%)} = \text{weight loss (g) by drying/sample amount (g)} \times 100.$$

An ignition loss can be determined in the following manner. A magnetic crucible is dried, allowed to stand and cool, and weighed precisely beforehand. Then, a sample (about 1 g) is put in the crucible, weighed precisely, and ignited for 2 hours in an electric furnace at 500° C. After cooling for 1 hour in a desiccator, the weight is measured, and the ignition loss is calculated by $$\text{Ignition loss (\%)} = \text{weight loss (g) by ignition/sample amount (g)} \times 100.$$

The amount of moisture absorption of the surfaced-treated inorganic fine powder may be not more than 1 wt %, preferably not more than 0.5 wt %, more preferably not more than 0.1 wt %, and further preferably not more than 0.05 wt %. When it is more than 1 wt %, the chargeability is degraded, and filming of the toner on a photoconductive member occurs. The amount of moisture absorption can be measured by using a continuous vapor absorption measuring device (BELSORP 18 manufactured by BEL JAPAN, INC.).

The degree of hydrophobicity can be determined in the following manner. A sample (0.2 g) is weighed in a 250 ml beaker containing 50 ml of distilled water. Then, methanol is added from a buret, whose end is put into the water, until the whole inorganic fine powder is wet while continuing the stirring slowly with a magnetic stirrer. Based on the amount a (ml) of methanol required to wet the inorganic fine powder completely, the degree of hydrophobicity is calculated by $$\text{Degree of hydrophobicity (\%)} = (a/(50+a)) \times 100.$$

(7) Powder physical Characteristics of Toner

In this embodiment, the volume-average particle size of toner base particles including a binder resin, a colorant, and wax is 3 to 7 μm, preferably 3 to 6.5 μm, and more preferably 3 to 4.5 μm. The particle size distribution is such that the content of the toner base particles having a particle size of 2.52 to 4 μm in a number distribution is 5 to 65% by number, and the toner base particles having a particle size of 6.35 to 10.1 μm in a volume distribution is 5 to 35% by volume.

Preferably, the particle size distribution is such that the content of the toner base particles having a particle size of 2.52 to 4 μm in the number distribution is 15 to 65% by number, and the toner base particles having a particle size of 6.35 to 10.1 μm in the volume distribution is 5 to 25% by volume. More preferably, the particle size distribution is such that the content of the toner base particles having a particle size of 2.52 to 4 μm in the number distribution is 25 to 65% by number, and the toner base particles having a particle size of 6.35 to 10.1 μm in the volume distribution is 5 to 15% by volume. The toner base particles with the above characteristics can provide high-resolution image quality, prevent reverse transfer and transfer voids during tandem transfer, and achieve the oilless fixing. When the volume-average particle size is more than 7 μm, the image quality and the transfer property cannot be ensured together. When the volume-average particle size is less than 3 μm, the handling property of the toner particles in development is reduced. When the content of the toner base particles having a particle size of 2.52 to 4 μm in the number distribution is less than 5% by number, the image quality and the transfer property cannot be ensured together. When it is more than 65% by number, the handling property of the toner particles in development is reduced. When the toner base particles having a particle size of 6.35 to 10.1 μm in the volume distribution is more than 35% by volume, the image quality and the transfer property cannot be ensured together. When it is less than 5% by volume, the toner productivity is reduced and the cost is increased. The coefficient of variation in the volume particle size distribution of the toner base particles is preferably 15 to 32%, more preferably 15 to 30%, and further preferably 15 to 25%. The coefficient of variation in the number particle size distribution of the toner base particles is preferably 15 to 35%, more preferably 15 to 30%, and further preferably 15 to 25%.

The coefficient of variation is obtained by dividing a standard deviation by an average particle size of the toner particles based on the measurement using Coulter Counter (manufactured by Coulter Electronics, Inc.). When the particle sizes of n particles are measured, the standard deviation can be expressed by the square root of the value that is obtained by dividing the square of a difference between each of the n measured values and the mean value by (n−1). In other words, the coefficient of variation indicates the degree of expansion of the particle size distribution. When the coefficient of variation of the volume particle size distribution or the number particle size distribution is less than 15%, the production becomes difficult, and the cost is increased. When the coefficient of variation of the volume particle size distribution is more than 32%, or when the coefficient of variation of the number particle size distribution is more than 35%, the particle size distribution is broader, and the agglomeration of toner is stronger. This may lead to filming of the toner on a photoconductive member, a transfer failure, and difficulty of recycling the residual toner in a cleanerless process. The fine powder in toner affects the flowability, image quality, and storage stability of the toner, filming of the toner on a photoconductive member, developing roller, or transfer member, the aging property, the transfer property, and particularly the multilayer transfer property in a tandem system. The fine powder also affects the offset resistance, glossiness, and transmittance in the oilless fixing. When the toner includes a release agent such as wax to achieve the oilless fixing, the amount of fine powder may affect compatibility between the oilless fixing and the tandem transfer property. If the amount of fine powder is excessively large, i.e., the content of the toner base particles having a particle size of 2.52 to 4 μm is more than 65% by number, the wax is not dispersed completely and is likely to be exposed on the toner surface, resulting in filming of the toner on a photoconductive member, developing roller, or transfer member. The adhesion of the fine powder to a heat roller is large, and thus tends to cause offset. In the tandem system, the agglomeration of the toner is likely to be stronger, which easily leads to a transfer failure of the second color during multilayer transfer. If the amount of fine powder is reduced, the image quality may be degraded. Therefore, an appropriate range is necessary. The particle size distribution is measured, e.g., by using Coulter Counter TA-II (manufactured by Coulter Electronics, Inc.). An interface (manufactured by Nikkaki Bios Co., Ltd.) for outputting a number distribution and a volume distribution and a personal computer are connected to the Coulter Counter TA-II. An electrolytic solution (about 50 ml) is prepared by including a surface-active agent (sodium lauryl sulfate) so as to have a concentration of 1%. About 2 mg of measuring toner is added to the electrolytic solution. This electrolytic solution in which the sample is suspended is dispersed for about 3 minutes with an ultrasonic dispersing device, and then is measured using the 70 μm aperture of the Coulter Counter TA-II. In the 70 μm aperture system, the measurement range of the particle size distribution is 1.26 μm to 50.8 μm. However, the region smaller than 2.0 μm is not suitable for practical use because the measurement accuracy or reproducibility is low under the influence of external noise or the like. Therefore, the measurement range is set from 2.0 μm to 50.8 μm.

A compression ratio calculated from a static bulk density and a dynamic bulk density can be used as an index of the flowability of toner. The toner flowability may be affected by the particle size distribution and particle shape of the toner, the additive, and the type or amount of wax. When the particle size distribution of the toner is narrow, less fine powder is present, the toner surface is not rough, the toner shape is close to spherical, a large amount of additive is added, and the additive has a small particle size, the compression ratio is reduced, and the toner flowability is increased. The compression ratio is preferably 5 to 40%, and more preferably 10 to 30%. This can ensure compatibility between the oilless fixing and the multilayer transfer property in the tandem system. When the compression ratio is less than 5%, the fixability is degraded, and particularly the transmittance is likely to be lower. Moreover, toner scatting from the developing roller may be increased. When the compression ratio is more than 40%, the transfer property is decreased to cause a transfer failure such as transfer voids in the tandem system.

(8) Carrier

A resin-coated carrier of this embodiment preferably includes a carrier core provided with a coating of fluorine modified silicone resin containing an aminosilane coupling agent. The carrier core may be, e.g., an iron powder carrier core, a ferrite carrier core, a magnetite carrier core, or a resin-dispersed carrier core in which a magnetic body is dispersed in the resin. An example of the ferrite carrier core is expressed generally by $$(MO)_X(Fe_2O_3)_Y$$

where M includes at least one selected from Cu, Zn, Fe, Mg, Mn, Ca, Li, Ti, Ni, Sn, Sr, Al, Ba, Co, and Mo, and X and Y are a molar ratio and satisfy X+Y=100. The ferrite carrier core includes $Fe_2O_3$ as the main material and at least one oxide of M selected from Cu, Zn, Fe, Mg, Mn, Ca, Li, Ti, Ni, Sn, Sr, Al, Ba, Co, and Mo. The ferrite carrier core may be produced in the following manner. First, the above materials such as each oxide are blended in an appropriate amount. The blend is placed in a wet ball mill, and then is pulverized and mixed for 10 hours. The resultant mixture is dried and kept at 950° C. for 4 hours. Moreover, the mixture is pulverized for 24 hours in the wet ball mill, to which a binder (polyvinyl alcohol), an antifoaming agent, a surface-active agent, and the like are added, thus forming a slurry with a particle size of 5 μm or less. The slurry is granulated and dried. The granulated substance is kept at 1300° C. for 6 hours while controlling the oxygen concentration. Subsequently, this substance was pulverized and further classified to achieve a desired particle size distribution.

A fluorine modified silicone resin may be used for the resin coating of the present invention. The fluorine modified silicone resin is preferably a cross-linked fluorine modified silicone resin obtained by the reaction between an organosilicon compound containing a perfluoroalkyl group and polyorganosiloxane. It is preferable that 3 to 20 parts by weight of the organosilicon compound containing a perfluoroalkyl gourp is mixed with 100 parts by weight of the polyorganosiloxane. The polyorganosiloxane preferably has at lease one repeating unit selected from Formulas (5) and (6).

Formula (5):

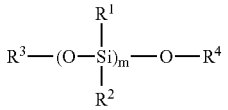

(where $R^1$ and $R^2$ are a hydrogen atom, a halogen atom, a hydroxy group, a methoxy group, an alkyl group having a carbon number of 1 to 4, or a phenyl group, $R^3$ and $R^4$ are an alkyl group having a carbon number of 1 to 4 or a phenyl group, and m represents a mean degree of polymerization and is positive integers (preferably in the range of 2 to 500, and more preferably in the range of 5 to 200)).

Formula (6):

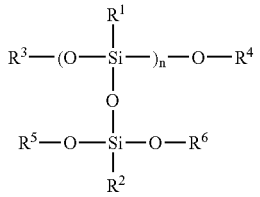

(where $R^1$ and $R^2$ are a hydrogen atom, a halogen atom, a hydroxy group, a methoxy group, an alkyl group having a carbon number of 1 to 4, or a phenyl group, $R^3$, $R^4$, $R^5$, and $R^6$ are an alkyl group having a carbon number of 1 to 4 or a phenyl group, and n represents a mean degree of polymerization and is positive integers (preferably in the range of 2 to 500, and more preferably in the range of 5 to 200)).

Examples of the organosilicon compound containing a perfluoroalkyl group include $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, and $(CF_3)_2CF(CF_2)_8CH_2CH_2Si(OCH_3)_3$. In particular, a compound containing a trifluoropropyl group is preferred.

In this embodiment, the aminosilane coupling agent is included in the resin coating. As the aminosilane coupling agent, e.g., the following known materials can be used: γ-(2-aminoethyl)aminopropyltrimethoxysilane, γ-(2-aminoethyl) aminopropylmethyldimethoxysilane, and octadecylmethyl [3-(trimethoxysilyl)propyl]ammonium chloride (corresponding to SH6020, SZ6023, and AY43-021 manufactured by Toray-Dow Corning Co., Ltd.); KBM602, KBM603, KBE903, and KBM573 (manufactured by Shin-Etsu Chemical Co., Ltd.). In particular, the primary amine is preferred. The secondary or tertiary amine that is substituted with a methyl group, an ethyl group, or a phenyl group has weak polarity and is less effective for raising the charge property of toner. When the amino group is replaced by an aminomethyl group, an aminoethyl group, or an aminophenyl group, the end of the silane coupling agent can be the primary amine. However, the amino group in the straight-chain organic group extended from silane does not contribute to the charge raising property and is affected by moisture under high humidity. Therefore, although the carrier may have charging ability for initial toner because the amino group is at the end, the charging ability is decreased during operation, resulting in a short life of the carrier.

By using the above aminosilane coupling agent with the fluorine modified silicone resin of this embodiment, the toner can be charged negatively while maintaining a sharp charge distribution. When the toner is supplied, it shows a quick rise in charge, and thus the toner consumption can be reduced. Moreover, the aminosilane coupling agent has the effect comparable to that of a cross-linking agent. Therefore, it can increase the degree of cross-linking of the coating of fluorine modified silicone resin as a base resin. Further, the hardness of the resin coating is improved, so that abrasion or peeling can be reduced over a long period of use. Accordingly, higher resistance to spent can be obtained, and the electrification can be stabilized by suppressing a decrease in the charging ability of the carrier, thus improving durability.

When wax having a low melting point is added to toner with the above configuration in an amount greater than a given value, the chargeability of the toner is rather unstable because the toner surface consists mainly of resin. There may be some cases where the chargeability is weaker and the rise in charge is slower. This tends to cause fog, poor uniformity of a solid image, and transfer voids or skipping during transfer. However, combining the toner with the carrier of this embodiment can overcome these problems and improve the handling property of the toner in a developing unit. Thus, the uniformity in density of an image can be improved in both the start and end of the development. Moreover, a so-called developing memory, i.e., a history that is left after taking a solid image, can be reduced.

The ratio of the aminosilane coupling agent to the resin is 5 to 40 wt %, and preferably 10 to 30 wt %. When the ratio is less than 5 wt %, no effect of the aminosilane coupling agent is observed. When the ratio is more than 40 wt %, the degree of cross-linking of the resin coating is excessively high, and a charge-up phenomenon is likely to occur. This may lead to image defects such as underdevelopment.

The resin coating also may include conductive fine powder to stabilize electrification and to prevent charge-up. Examples of the conductive fine powder include carbon black such as oil furnace black or acetylene black, a semiconductive oxide such as titanium oxide or zinc oxide, and powder of titanium oxide, zinc oxide, barium sulfate, aluminum borate, or potassium titanate coated with tin oxide, carbon black, or metal. The specific resistance is preferably not more than $10^{10}\Omega\cdot cm$. The content of the conductive fine powder is preferably 1 to 15 wt %. When the conductive fine powder is included to some extent in the resin coating, the hardness of the resin coating can be improved by a filler effect. However, when the content is more than 15 wt %, the conductive fine powder may interfere with the formation of the resin coating, resulting in lower adherence and hardness. An excessive amount of conductive fine powder in a full color developer may cause the color contamination of toner that is transferred and fixed on paper.

The carrier used in the present invention preferably has an average particle size of 20 to 70 μm. When the average particle size is less than 20 μm, the abundance ratio of fine particles in the carrier particle distribution is increased, and magnetization per carrier particle is reduced. Therefore, the carrier is likely to be developed on a photoconductive member. When the average particle size is more than 70 μm, the specific surface area of the carrier particles is smaller, and the toner retaining ability is decreased to cause toner scattering. For full color images including many solid portions, the reproduction of the solid portions is particularly worse.

A method for forming a coating on the carrier core is not particularly limited, and any known coating methods can be used, such as a dipping method of dipping core material powder in a solution for forming a coating layer, a spaying method of spaying a solution for forming a coating layer on the surface of a core material, a fluidized bed method of spraying a solution for forming a coating layer to a core material while the core material is floated by fluidizing air, and a kneader and coater method of mixing a core material and a solution for forming a coating layer in a kneader and coater, and removing a solvent. In addition to these wet coating methods, a dry coating method also can be used. The dry coating method includes, e.g., mixing resin powder and a core material at high speed, and fusing the resin powder on the surface of the core material by utilizing the frictional heat. In particular, the wet coating method is preferred for coating of the fluorine modified silicone resin containing an aminosilane coupling agent of the present invention.

A solvent of the solution for forming a coating layer is not particularly limited as long as it dissolves the coating resin, and can be selected in accordance with the coating resin to be used. Examples of the solvent include aromatic hydrocarbons such as toluene and xylene, ketones such as acetone and methyl ethyl ketone, and ethers such as tetrahydrofuran and dioxane. The amount of coating resin is preferably 0.2 to 6.0 wt %, more preferably 0.5 to 5.0 wt %, further preferably 0.6 to 4.0 wt %, and most preferably 0.7 to 3 wt % with respect to the carrier core. When the amount of coating resin is less than 0.2 wt %, a uniform coating cannot be formed on the carrier surface. Therefore, the carrier is affected significantly by the characteristics of the carrier core and cannot provide a sufficient effect of the fluorine modified silicone resin containing an aminosilane coupling agent. When the amount of coating resin is more than 6.0 wt %, the coating is too thick, and granulation between the carrier particles occurs. Therefore, the carrier particles are not likely to be uniform.

It is preferable that a baking treatment is performed after coating the carrier core with the fluorine modified silicone resin containing an aminosilane coupling agent. A means for the baking treatment is not particularly limited, and either of external and internal heating systems may be used. For example, a fixed or fluidized electric furnace, a rotary kiln electric furnace, or a burner furnace can be used as well. Alternatively, baking may be performed with a microwave. The baking temperature should be high enough to provide the effect of fluorine silicone that can improve the spent resistance of the resin coating, e.g., preferably 200° C. to 350° C., and more preferably 220° C. to 280° C. The treatment time is preferably 1.5 to 2.5 hours. A lower temperature may degrade the hardness of the resin coating itself, while an excessively high temperature may cause a charge reduction.

(9) Two-component Development

Both direct-current bias and alternating-current bias are applied between a photoconductive member and a developing roller. In this case, it is preferable that the frequency is 1 to 10 kHz, the alternating-current bias is 1.0 to 2.5 kV (p-p), and the circumferential velocity ratio of the photoconductive member to the developing roller is 1:1.2 to 1:2. More preferably, the frequency is 3.5 to 8 kHz, the alternating-current bias is 1.2 to 2.0 kV (p-p), and the circumferential velocity ratio of the photoconductive member to the developing roller is 1:1.5 to 1:1.8.

Further preferably, the frequency is 5.5 to 7 kHz, the alternating-current bias is 1.5 to 2.0 kV (p-p), and the circumferential velocity ratio of the photoconductive member to the developing roller is 1:1.6 to 1:1.8.

When the above development process configuration is used with toner or a two-component developer of this embodiment, it is possible to reproduce dots faithfully, to improve the development γ characteristics, and to ensure a high quality image and the oilless fixability. Moreover, charge-up can be suppressed under low humidity even with a high resistance carrier. Therefore, high image density can be obtained during continuous use. By combining toner that can exhibit high chargeability, the carrier configuration, and the alternating-current bias, the adhesion between the toner and the carrier can be reduced, and the image density can be maintained. Moreover, it is possible to reduce fog and to reproduce dots faithfully. When the frequency is less than 1 kHz, the dot reproducibility is decreased, resulting in poor reproduction of middle tones. When the frequency is more than 10 kHz, the toner cannot follow in the development region, and no effect is observed. In the two-component development using a high resistance carrier, the frequency within the above range is more effective for reciprocating action between the carrier and the toner than between the developing roller and the photoconductive member. Thus, the toner can be liberated slightly from the carrier. This may improve the dot reproducibility and the middle tone reproducibility, and provide high image density. When the alternating-current bias is lower than 1.0 kV (p-p), the effect of suppressing charge-up cannot be obtained. When the alternating-current bias is more than 2.5 kV (p-p), fog is increased. When the circumferential velocity ratio is less than 1:1.2 (the developing roller gets slower), it is difficult to ensure the image density. When the circumferential velocity ratio is more than 1:2 (the developing roller gets faster), toner scatting is increased.

(10) Tandem Color Process p This embodiment employs the following transfer process for high-speed color image formation. A plurality of toner image forming stations, each of which includes a photoconductive member, a charging member, and a toner support member, are used. In a primary transfer process, an electrostatic latent image formed on the photoconductive member is made visible by development, and a toner image thus developed is transferred to an endless transfer member that is in contact with the photoconductive member. The primary transfer process is performed continuously in sequence so that a multilayer toner image is formed on the transfer member. Then, a secondary transfer process is performed by collectively transferring the multilayer toner image from the transfer member to a transfer medium such as paper or OHP sheet. The transfer process satisfies the relationship expressed by $$d1/v \leqq 0.65$$

where d1 (mm) is a distance between the first primary transfer position and the second primary transfer position, and v (mm/ s) is a circumferential velocity of the photoconductive member. This configuration can reduce the machine size and improve the printing speed. To process 16 sheets (A4) per minute and to make the size small enough to be used for SOHO (small office/home office) purposes, a distance between the toner image forming stations should be as short as possible, while the processing speed should be enhanced. Thus, $d1/v \leqq 0.65$ is considered as the minimum requirement to achieve both small size and high printing speed.

In this configuration, however, when a period of time from the primary transfer of the first color (yellow toner) to that of the second color (magenta toner) is extremely short, the charge of the transfer member or the charge of the transferred toner hardly is relieved. Therefore, when the magenta toner is transferred onto the yellow toner, it is repelled by the charging action of the yellow toner. This may lead to lower transfer efficiency and transfer voids. When the third color (cyan) toner is transferred onto the yellow and the magenta toner, the cyan toner is scattered, and a transfer failure or transfer voids is caused considerably. Moreover, toner having a specified particle size is developed selectively with repeated use, and the individual toner particles differ significantly in flowability, so that frictional charge opportunities are different. Thus, the charge amount is varied to further reduce the transfer property. In such a case, therefore, the toner or two-component developer of this embodiment can stabilize the charge distribution and suppress the overcharge and flowability variations of toner. Accordingly, it is possible to prevent lower transfer efficiency, transfer voids, and reverse transfer without sacrificing the fixing property.

(11) Cleanerless Process

The toner of this embodiment can be used preferably in an electrographic apparatus that employs a cleanerless process as a basic configuration. While a cleaning process recycles the toner remaining on the photoconductive member after a transfer process, the cleanerless process performs the subsequent charging, exposure, and development processes without the cleaning process.

The use of the toner or two-component developer of this embodiment can suppress the agglomeration of the toner, prevent overcharge, stabilize electrification, and achieve high transfer efficiency. Moreover, the residual toner in the non-image portion can be recycled successfully for development because of the improved uniform dispersibility in the resin, good chargeability, and the releasability of materials. Thus, there is no developing memory in which the previous image pattern has been left in the non-image portion.

(11) Oiless Color Fixing

The toner of this embodiment can be used preferably in an electrographic apparatus having a fixing process with an oilless fixing configuration that applies no oil to any fixing means. As a heating means, electromagnetic induction heating is suitable in view of reducing a warm-up time and power consumption. The oilless fixing configuration includes a magnetic field generation means and a heating and pressing means. The heating and pressing means includes at least a rotational heating member and a rotational pressing member. There is a certain nip between the rotational heating member and the rotational pressing member. The rotational heating member includes at least a heat generation layer formed by electromagnetic induction and a release layer. A transfer medium such as copy paper to which toner has been transferred is allowed to pass between the rotational heating member and the rotational pressing member so as to fix the toner.

Another configuration in which a heating member is separated from a fixing member and a fixing belt runs between the two members also may be used preferably. The fixing belt may be, e.g., a nickel electroformed belt having heat resistance and deformability or a heat-resistant polyimide belt. Silicone rubber, fluorocarbon rubber, or fluorocarbon resin may be used as a surface coating to improve the releasability.

In the conventional fixing process, release oil has been applied to prevent offset. The toner that exhibits releasability without using oil can eliminate the need for application of the release oil. However, if the release oil is not applied to the fixing means, it can be charged easily. Therefore, when an unfixed toner image is close to the heating member or the fixing member, the toner may be scattered due to the influence of charge. Such scattering is likely to occur particularly under low temperature and low humidity.

In contrast, the toner of this embodiment can prevent the occurrence of offset without using oil and also can provide high color transmittance. Thus, the use of the toner of this embodiment can suppress overcharge as well as scattering caused by the charging action of the heating member or the fixing member.

The toner or two-component developer of the present invention also can be used in the following image forming apparatuses.

(i) An image forming apparatus includes a developing means that applies a direct-current bias and an alternating-current bias having a frequency of 1 to 10 kHz and a bias of 1.0 to 2.5 kV (p-p) between a photoconductive member and a developing roller. The circumferential velocity ratio of the photoconductive member to the developing roller is 1:1.2 to 1:2. This image forming apparatus uses toner including aggregated particles that include at least resin particles, pigment particles, and wax particles. The wax is at least one selected from A: ester wax that has an iodine value of not more than 25, a saponification value of 30 to 300, and an endothermic peak temperature (melting point) of 50° C. to 100° C. based on the DSC method, and B: wax that is obtained by the reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melting point) of 50° C. to 120° C. based on the DSC method.

(ii) An image forming apparatus includes a developing means that applies a direct-current bias and an alternating-current bias having a frequency of 1 to 10 kHz and a bias of 1.0 to 2.5 kV (p-p) between a photoconductive member and a developing roller. The circumferential velocity ratio of the photoconductive member to the developing roller is 1:1.2 to 1:2. This image forming apparatus uses a two-component developer including toner and a carrier. The toner includes aggregated particles that include at least resin particles, pigment particles, and wax particles. A fused film of the resin is formed on the surface of the toner. The wax is at least one selected from A: ester wax that has an iodine value of not more than 25, a saponification value of 30 to 300, and an endothermic peak temperature (melting point) of 50° C. to 100° C. based on the DSC method, and B: wax that is obtained by the reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melting point) of 50° C. to 120° C. based on the DSC method. The carrier includes magnetic particles as a core material, and at least the surface of the core material is coated with a fluorine modified silicone resin containing an aminosilane coupling agent.

(iii) An image forming apparatus includes a plurality of toner image forming stations, each of which includes an image support member, a charging member for forming an electrostatic latent image on the image support member, and toner support member. The electrostatic latent image formed on each of the image support members is made visible by development with toner including aggregated particles that include at least resin particles, pigment particles, and wax particles. The wax is at least one selected from A: ester wax that has an iodine value of not more than 25, a saponification value of 30 to 300, and an endothermic peak temperature (melting point) of 50° C. to 100° C. based on the DSC method, and B: wax that is obtained by the reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melting point) of 50° C. to 120° C. based on the DSC method. This image forming apparatus has a transfer system in which the toner images obtained by the development of the electrostatic latent images are transferred successively to a transfer medium. The transfer system satisfies the relationship expressed by $d1/v \leqq 0.65$ (sec) where d1 (mm) is a distance between a first transfer position and a second transfer position, or between the second transfer position and a third transfer position, or between the third transfer position and a fourth transfer position, and v (mm/s) is a circumferential velocity of the image support member.

(iv) An image forming apparatus includes a plurality of toner image forming stations, each of which includes an image support member, a charging member for forming an electrostatic latent image on the image support member, and toner support member. The electrostatic latent image formed on each of the image support members is made visible by development with a two-component developer including toner and a carrier. The toner includes aggregated particles that include at least resin particles, pigment particles, and wax particles. A fused film of the resin is formed on the surface of the toner. The wax is at least one selected from A: ester wax that has an iodine value of not more than 25, a saponification value of 30 to 300, and an endothermic peak temperature (melting point) of 50° C. to 100° C. based on the DSC method, and B: wax that is obtained by the reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melting point) of 50° C. to 120° C. based on the DSC method. The carrier includes magnetic particles as a core material, and at least the surface of the core material is coated with a fluorine modified silicone resin containing an aminosilane coupling agent. This image forming apparatus has a transfer system in which the toner images obtained by the development of the electrostatic latent images are transferred successively to a transfer medium. The transfer system satisfies the relationship expressed by $d1/v \leqq 0.65$ (sec) where d1 (mm) is a distance between a first transfer position and a second transfer position, or between the second transfer position and a third transfer position, or between the third transfer position and a fourth transfer position, and v (mm/s) is a circumferential velocity of the image support member.

In this embodiment, ester wax or wax derived from unsaturated hydrocarbon wax is used. The polarity of a surface-active agent of the wax particle dispersion is opposite to that of a surface-active agent of the resin particle dispersion. When aggregated particles are formed, a surface-active agent having the same polarity as that of the surface-active agent of the wax particle dispersion is added. Therefore, it is possible to reduce the amount of wax or pigment particles that are not aggregated and thus are suspended in the aqueous medium, to achieve uniform mixing and aggregation, and to improve the color reproducibility. Moreover, the two-component developer includes a carrier in which the carrier core is coated with the fluorine modified silicone resin containing an aminosilane coupling agent. This configuration can achieve the oilless fixing that prevents offset without using oil while maintaining high OHP transmittance, and eliminate spent of the toner components on the carrier to make the life longer. Moreover, high transfer efficiency can be ensured by suppressing transfer voids or scattering during transfer.

Figure 5:
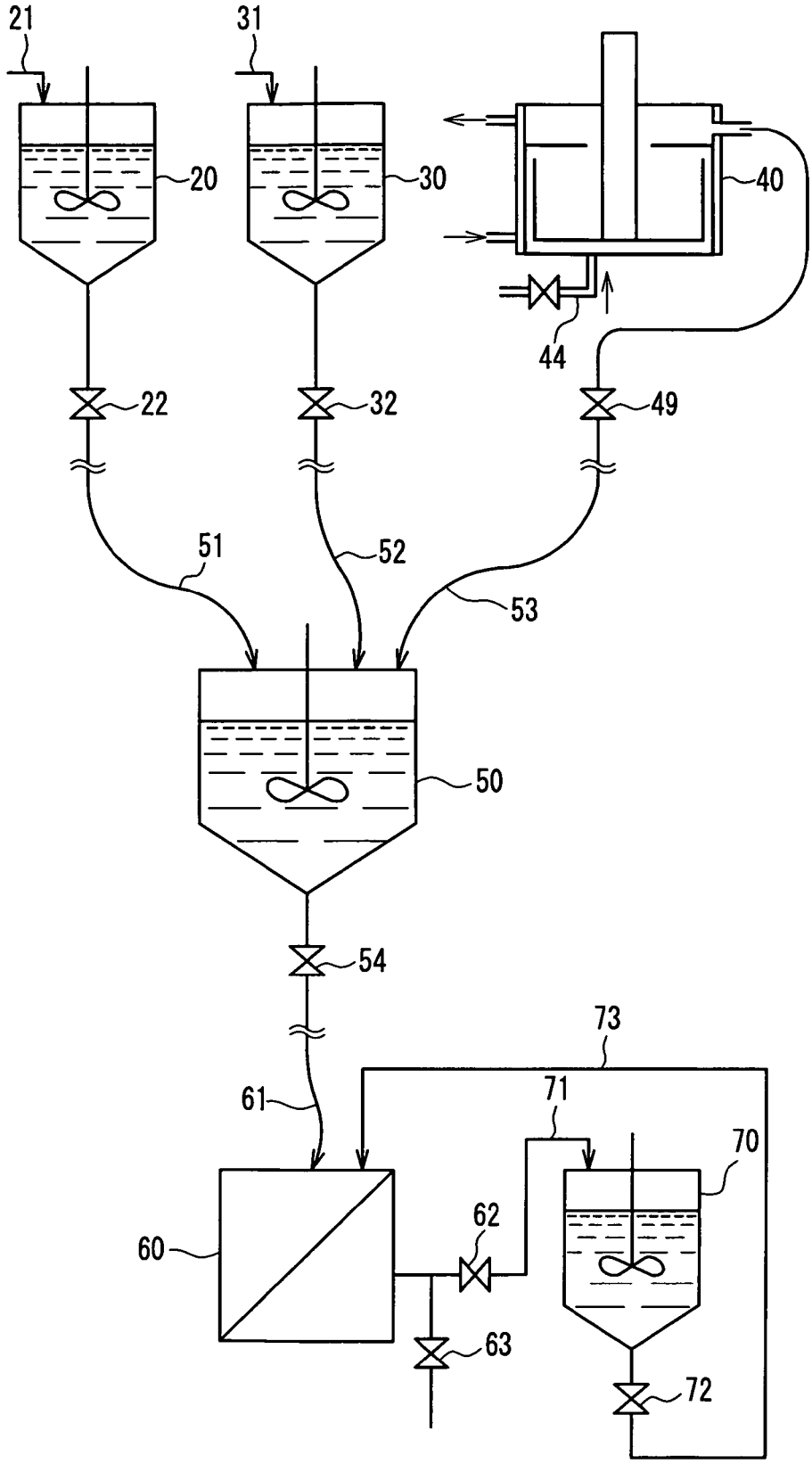

Next, an example of the manufacturing process of toner of the present invention will be described by referring to FIG. 5. Reference numeral 20 is an emulsion polymerization tank in which monomers, an anionic surface-active agent (emulsifier), a polymerization initiator, ion-exchanged water, and the like are supplied from a raw material supply line 21, and emulsion polymerization is performed. The resultant polymer is resin particles with an average particle size of 0.1 to 0.2 μm. Reference numeral 30 is a pigment dispersion tank in which a pigment, an anionic surface-active agent, and ion-exchanged water are supplied from a raw material supply line 31 to produce pigment particles with an average particle size of 0.1 to 0.2 μm. Reference numeral 40 is a wax dispersion tank (see FIGS. 3 and 4) in which wax, a cationic surface-active agent, and ion-exchanged water are supplied from a raw material supply line 44 to produce wax particles with an average particle size of 0.2 to 0.5 μm. When the primary particles are produced in each of the tanks 20, 30, and 40, valves 22, 32, and 49 are opened to let the primary materials and a cationic surface-active agent (at a predetermined mixing ratio) into an aggregation tank 50 through supply lines 51, 52, and 53, respectively. Then, aggregated particles (secondary particles) are formed by ionic aggregation of the above particles in water. In this case, it is important to incorporate wax into the aggregated particles efficiently. Thereafter, the aggregated particles are coated with a fused film by heating. Next, a valve 54 is opened to let the aggregated particles into a filtration separation tank 60 through a supply line 61. In the filtration separation tank 60, the aggregated particles are separated. Then, a valve 62 is opened to let the aggregated particles into a washing tank 70 through a supply line 71. After the aggregated particles are washed with water, a valve 72 is opened to let them into the filtration separation tank 60 through a supply line 73, thereby separating the aggregated particles from water. This operation is repeated several times, and then a valve 63 is opened to provide toner of the purified aggregated particles. Subsequently, the toner is dried to make a toner product.

In the above manufacturing process, a funnel glass filter No. 5A (7 μm) may be used as a filter of the filtration separation tank 60.

Figure 6A:
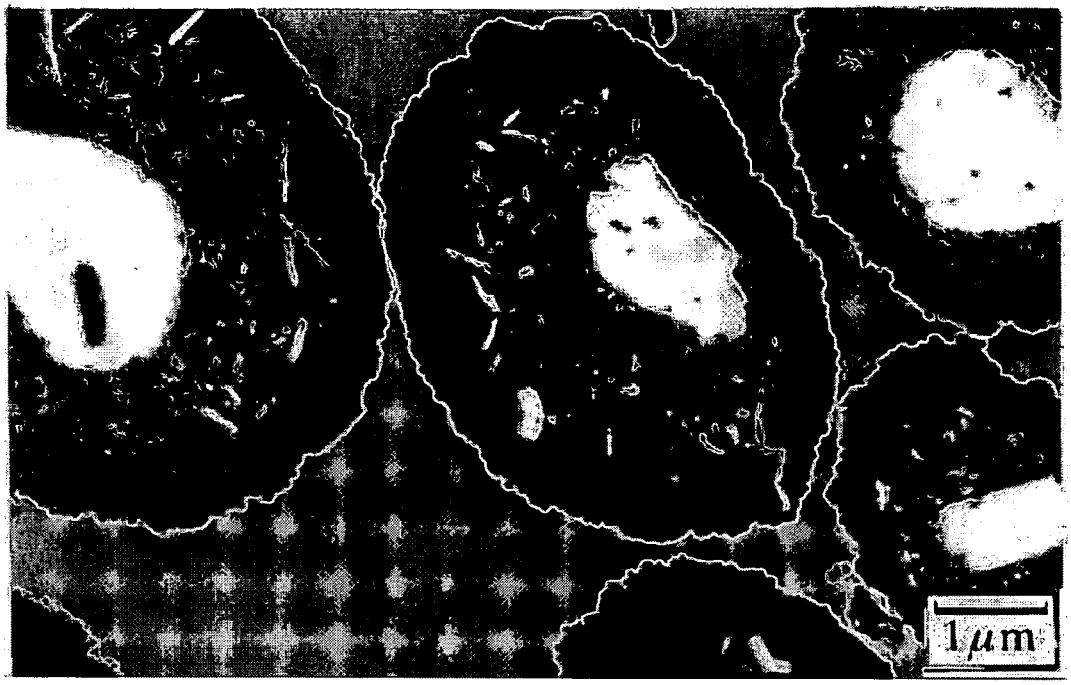
FIG. 6A is a transmission electron microscope (TEM) image of toner particles of a toner base produced in an example of the present invention (magnification: 15000×).

FIG. 6A is a transmission electron microscope (TEM) image of toner particles of a toner base M3 produced in the following example (magnification: 15000×). All the resins are melted and do not remain in the form of particles. In FIG. 6A, the central portion of each particle seems white because the wax is incorporated into the resin. The resin and pigment particles are dispersed around the central portion as an intermediate layer. Moreover, a resin layer (outermost shell) is formed around the intermediate layer.

Figure 6B:
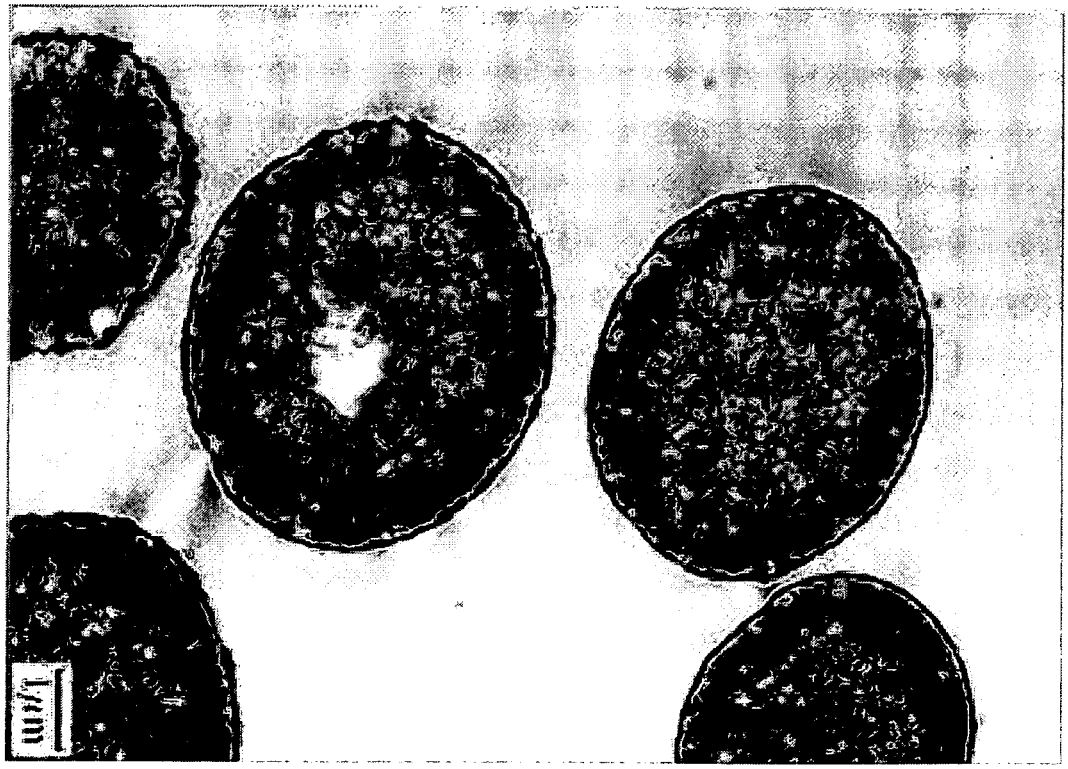
FIG. 6B is a TEM image of toner particles of a toner base produced in another example of the present invention (magnification: 12000×).

FIG. 6B is a TEM image of toner particles of a toner base M6 produced in the following example (magnification: 12000×). All the resins are melted and do not remain in the form of particles. In FIG. 6B, the wax particles, the pigment particles, and the resin are mixed and dispersed in each particle, and the outer layer of the particle is a resin layer. Compared to FIG. 6A, there are few particles in which only wax is present in the central portion. This can be attributed to the influence of a difference in the heat characteristics or composition of the wax. The volume average particle size of the toner is 3 μm to 7 μm.

Hereinafter, the present invention will be described in more detail by way of examples. However, the present invention is not limited to the examples.

Carrier Producing Example 1

MnO (39.7 mol %), MgO (9.9 mol %), $Fe_2O_3$ (49.6 mol %), and SrO (0.8 mol %) were placed in a wet ball mill, and then were pulverized and mixed for 10 hours. The resultant mixture was dried, kept at 950° C. for 4 hours, and temporarily fired. This was pulverized for 24 hours in a wet ball mill, and then was granulated and dried by a spray dryer. The granulated substance was kept in an electric furnace at 1270° C. for 6 hours in an atmosphere of oxygen concentration of 2%, and fully fired. The fired substance was ground and further classified, thus producing a core material of ferrite particles that had an average particle size of 50 μm and a saturation magnetization of 65 emu/g in an applied magnetic field of 3000 oersted.

Next, 250 g of polyorganosiloxane expressed by Formula 7 in which $(CH_3)_2SiO$— unit is 15.4 mol % and Formula 8 in which $CH_3SiO_{3/2}$— unit is 84.6 mol % was allowed to react with 21 g of $CF_3CH_2CH_2Si(OCH_3)_3$ to produce a fluorine modified silicone resin. This reaction was a demethoxy reaction with which an organosilicon compound containing a perfluoroalkyl group was introduced into polyorganosiloxane. Then, 100 g of the fluorine modified silicone resin (as represented in terms of solid content) and 10 g of aminosilane coupling agent (γ-aminopropyltriethoxysilane) were weighed and dissolved in 300 ml of toluene solvent.

Formula 7:

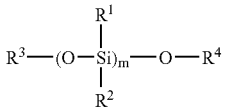

(where $R^1$, $R^2$, $R^3$, and $R^4$ are a methyl group, and m is a mean degree of polymerization of 100)

Formula 8:

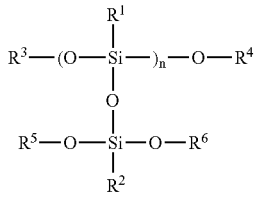

(where $R^1$, $R^2$, $R^3$, $R^4$, $R^5$, and $R^6$ are a methyl group, and n is a mean degree of polymerization of 80)

Using a dip and dry coater, 10 kg of the ferrite particles were coated by stirring the resin coating solution for 20 minutes, and then were baked at 260° C. for 1 hour, providing a carrier A1.

Carrier Producing Example 2

A core material was produced in the same manner as the Carrier Producing Example 1 except that $CF_3CH_2CH_2Si(OCH_3)_3$ was changed to $C_8F_{17}CH_2CH_2Si(OCH_3)_3$, and a coating was applied, thus providing a carrier A2.

Carrier Producing Example 3

A core material was produced in the same manner as the Carrier Producing Example 1 except that a conductive carbon (manufactured by Ketjenblack International Corporation EC) was dispersed in an amount of 5 wt % per the resin solid content by using a pearl mill, and a coating was applied, thus providing a carrier A3.

Carrier Producing Example 4

A core material was produced in the same manner as the Carrier Producing Example 3 except that the amount of aminosilane coupling agent to be added was changed to 30 g, and a coating was applied, thus providing a carrier A4.

Carrier Producing Comparative Example 5

A core material was produced in the same manner as the Carrier Producing Example 3 except that the amount of aminosilane coupling agent to be added was changed to 50 g, and a coating was applied, thus providing a carrier b1.

Carrier Producing Comparative Example 6

As a coating resin, 100 g of straight silicone (SR-2411 manufactured by Dow Corning Toray Silicone Co., Ltd.) was weighed in terms of solid content and dissolved in 300 cc of toluene solvent. Using a dip and dry coater, 10 kg of the ferrite particles were coated by stirring the resin coating solution for 20 minutes, and then were baked at 210° C. for 1 hour, providing a carrier b2.

Carrier Producing Comparative Example 7

As a coating resin, 100 g of perfluorooctylethyl acrylate/methacrylate copolymer was weighed in terms of solid content and dissolved in 300 cc of toluene solvent. Using a dip and dry coater, 10 kg of the ferrite particles were coated by stirring the resin coating solution for 20 minutes, and then were baked at 200° C. for 1 hour, providing a carrier b3.

Carrier Producing Comparative Example 8

As a coating resin, 100 g of acrylic modified silicone resin (KR-9706 manufactured by Shin-Etsu Chemical Co., Ltd.) was weighed in terms of solid content and dissolved in 300 cc of toluene solvent. Using a dip and dry coater, 10 kg of the ferrite particles were coated by stirring the resin coating solution for 20 minutes, and then were baked at 210° C. for 1 hour, providing a carrier b4.

Examples of the toner of the present invention will be described below. However, the present invention is not limited to the examples. In the following examples, Mn is a number-average molecular weight, Mw is a weight-average molecular weight, Mz is a Z average molecular weight, Tm is a softening point, and Tg is a glass transition point.

(1) Resin Particle Dispersion R1

A monomer solution including 192 g of styrene, 48 g of n-butylacrylate, and 3.6 g of acrylic acid was dispersed in 200 ml of ion-exchanged water with 6 g of anionic surface-active agent (NEOGEN RK manufactured by Dai-Ichi Kogyo Seiyaku Co., Ltd.), 12 g of dodecanethiol, and 2.4 g of carbon tetrabromide. Then, 2.4 g of potassium persulfate was added to the resultant solution, and emulsion polymerization was performed at 70° C. for 6 hours. Thus, a resin particle dispersion R1 was prepared, in which the resin particles having Mn of 3100, Mw of 25000, Tm of 115° C., Tg of 52° C., and a median diameter of 0.12 μm were dispersed.

(2) Resin Particle Dispersion R2

A monomer solution including 176 g of styrene, 64 g of n-butylacrylate, and 3.6 g of acrylic acid was dispersed in 200 ml of ion-exchanged water with 6 g of anionic surface-active agent (NEOGEN RK manufactured by Dai-Ichi Kogyo Seiyaku Co., Ltd.), 12 g of dodecanethiol, and 2.4 g of carbon tetrabromide. Then, 2.4 g of potassium persulfate was added to the resultant solution, and emulsion polymerization was performed at 70° C. for 5 hours. Thus, a resin particle dispersion R2 was prepared, in which the resin particles having Mn of 3000, Mw of 22000, Tm of 108° C., Tg of 50° C., and a median diameter of 0.18 μm were dispersed.

(3) Resin Particle Dispersion R3

A monomer solution including 212 g of styrene, 28 g of n-butylacrylate, and 3 g of acrylic acid was dispersed in 200 ml of ion-exchanged water with 6 g of anionic surface-active agent (NEOGEN RK manufactured by Dai-Ichi Kogyo Seiyaku Co., Ltd.), 12 g of dodecanethiol, and 2.4 g of carbon tetrabromide. Then, 2.4 g of potassium persulfate was added to the resultant solution, and emulsion polymerization was performed at 70° C. for 5 hours. Thus, a resin particle dispersion R3 was prepared, in which the resin particles having Mn of 2800, Mw of 23000, Tm of 103° C., Tg of 62° C., and a median diameter of 0.21 μm were dispersed.

(4) Colorant Particle Dispersion 20 g of magenta pigment (KETRED307 manufactured by Dainippon Ink and Chemicals, Inc.), 3 g of anionic surface-active agent (NEOGEN R manufactured by Dai-Ichi Kogyo Seiyaku Co., Ltd), and 77 ml of ion-exchanged water were mixed and dispersed by using an ultrasonic dispersing device at an oscillation frequency of 30 kHz for 20 minutes. Thus, a colorant particle dispersion was prepared, in which the colorant particles having a median diameter of 0.12 μm were dispersed.

(5) Wax Particle Dispersion 30 g of wax in Table 1, 2 or 3, 2 g of stearic acid amine hydrochloride, 0.5 g of polyvinyl alcohol, and 68 ml of ion-exchanged water were mixed and heated at a temperature that was not less than the melting point of the wax. Using a dispersing device as shown in FIGS. 3 and 4, the mixture was dispersed at a rotational speed of 40 m/s or more for 3 minutes. Thus, a wax particle dispersion was prepared, in which the wax particles having a medium diameter of 0.1 to 0.2 μm were dispersed. WA-4 was heated under high pressure to produce a dispersion.

TABLE 1

| Wax | Material | Melting point Tw(° C.) | Volume ratio Ct(%) | Heating loss Ck(wt %) | Iodine value | Saponification value |
|---|---|---|---|---|---|---|
| WA-1 | Hydrogenated jojoba oil | 68 | 18.5 | 2.8 | 2 | 95.7 |
| WA-2 | Carnauba wax | 83 | 15.3 | 4.1 | 10 | 80 |
| WA-3 | Hydrogenated meadowfoam oil | 71 | 3 | 2.5 | 2 | 90 |

TABLE 2

| | | Melting point Tw(° C.) | Acid value (mgKOH/g) | Penetration number |
|---|---|---|---|---|
| WA-4 | polypropylene/maleic anhydride/alcohol-type wax with a carbon number of less than 30/tert-butylperoxy isopropyl monocarbonate: 100/20/8/4 parts by weight | 98 | 45 | 1 |

TABLE 3

| | Mnr | Mwr | Mzr | Mwr/Mnr | Mzr/Mnr | Peak |
|---|---|---|---|---|---|---|
| WA-1 | 1009 | 1072 | 1118 | 1.06 | 1.11 | $1.02 \times 10^3$ |
| WA-2 | 1100 | 1198 | 1290 | 1.09 | 1.17 | $1.2 \times 10^3$ |
| WA-3 | 1015 | 1078 | 1124 | 1.06 | 1.11 | $1.03 \times 10^3$ |
| WA-4 | 1400 | 2030 | 2810 | 1.45 | 2.01 | $2.1 \times 10^3$ |

(6) Preparation of Toner Base M1 (The Mixing and Aggregation of a Dispersion and the Production of Heat-treated Particles)

In a 2000 ml four-neck flask equipped with a cooling tube and a thermometer were placed 210 g of first resin particle dispersion R1, 20 g of colorant particle dispersion, 50 g of wax particle dispersion WA-1, and 200 ml of ion-exchanged water, and then mixed and dispersed by using a homogenizer (Ultratalax T50 manufactured by IKA CO., LTD.). Thus, a particle dispersion was prepared.

Subsequently, 2.8 g of cationic surface-active agent (SANISOL B-50 manufactured by Kao Corporation) and 60 g of ion-exchanged water were added to the particle dispersion. The flask was put in an oil bath, heated to 50° C. while stirring the dispersion, and maintained for 60 minutes, thus providing an aggregated particle dispersion. The aggregated particle dispersion was observed by using a Coulter counter (Multisizer 2 manufactured by Coulter Electronics, Inc.) and confirmed to include particles having a volume-average particle size of about 4.1 μm. Thereafter, the temperature of the aggregated particle dispersion was raised to 55° C. and kept for 1 hour, thus providing a melted particle dispersion that included melted particles having a volume-average particle size of about 4.8 μm.

The pH of the melted particle dispersion was adjusted to 7.0 by dropping 0.5 M/L NaOH. The stainless steel flask was sealed with a magnetic seal, heated to 90° C. while stirring the dispersion, and maintained for 2 hours. After cooling, the reaction product (toner base particles) was filtered and washed three times with ion-exchanged water. The toner base particles thus obtained were dried at 40° C. for 6 hours by using a fluid-type dryer, resulting in a toner base M1.

(7) Preparation of Toner Base M2

A toner base M2 was produced in the same manner as the toner base M1 except that the resin particle dispersion R3 and 70 g of wax particle dispersion WA-4 were used in preparing an aggregated particle dispersion. (8) Preparation of toner base M3

In a stainless steel round flask were placed 210 g of first resin particle dispersion R1, 20 g of colorant particle dispersion, 50 g of wax particle dispersion WA-1, and 110 parts by weight of ion-exchanged water, and then mixed and dispersed by using a homogenizer (Ultratalax T50 manufactured by IKA CO., LTD.). Thus, a particle dispersion was prepared.

Subsequently, 2.8 g of cationic surface-active agent (SANISOL B-50 manufactured by Kao Corporation) and 60 g of ion-exchanged water were added to the particle dispersion. The flask was put in an oil bath, heated to 50° C. while stirring the dispersion, and maintained for 60 minutes, thus providing an aggregated particle dispersion. The aggregated particle dispersion was observed by using a Coulter counter (Multisizer 2 manufactured by Coulter Electronics, Inc.) and confirmed to include particles having a volume-average particle size of about 4.1 μm. Thereafter, the temperature of the aggregated particle dispersion was raised to 55° C. and kept for 1 hour, thus providing a melted particle dispersion that included melted particles having a volume-average particle size of about 4.8 μm.

The pH of the melted particle dispersion was adjusted to 7.0 by dropping 0.5 M/L NaOH. Then, 44 g of second resin particle dispersion R1 was added to the melted particle dispersion. The stainless steel flask was sealed with a magnetic seal, heated to 90° C. while stirring the dispersion, and maintained for 2 hours. Consequently, the second resin particles were formed into a fused film, and a toner base particle dispersion was provided. After cooling, the toner base particles were filtered and washed three times with ion-exchanged water. The toner base particles thus obtained were dried at 40° C. for 6 hours by using a fluid-type dryer, resulting in a toner base M3 in which the second resin served as a shell.

(9) Preparation of Toner Base M4

A toner base M4 was produced in the same manner as the toner base M3 except that the first resin particle dispersion R1 and 65 g of wax particle dispersion WA-2 were used in preparing an aggregated particle dispersion, and the second resin particle dispersion R3 was added after pH adjustment.

(10) Preparation of Toner Base M5

A toner base M5 was produced in the same manner as the toner base M3 except that the first resin particle dispersion R2 and 75 g of wax particle dispersion WA-3 were used in preparing an aggregated particle dispersion, and the second resin particle dispersion R3 was added after pH adjustment.

(11) Preparation of Toner Base M6

A toner base M6 was produced in the same manner as the toner base M3 except that the first resin particle dispersion R2 and 85 g of wax particle dispersion WA-4 were used in preparing an aggregated particle dispersion, and the second resin particle dispersion R3 was added after pH adjustment.

Cyan toner, yellow toner, and black toner were produced in the same manner as magenta toner. Phthalocyanine pigments (KETBLUE111 manufactured by Dainippon Ink and Chemicals, Inc.) were used for the cyan toner, yellow pigments (Y180 manufactured by Clariant) were used for the yellow toner, and carbon black (MA100S manufactured by Mitsubishi Chemical Corporation) was used for the black toner.

(12) Preparation of Toner Base m11

A toner base m11 was produced in the same manner as the toner base M1 except that the first resin particle dispersion R2 and 85 g of paraffin wax (mp 80° C.) instead of the wax particle dispersion were used in preparing an aggregated particle dispersion.

The toner thus obtained caused lower transfer efficiency, transfer voids, and filming on a photoconductive member that was attributed to the dispersion of the wax. When the durability of the developer was 10 k, fog was increased. For fixing, the transmittance was 50% or less. The toner coagulated in a storage life test.

(13) Preparation of Toner Base m12

A toner base m12 was produced in the same manner as the toner base M1 except that the first resin particle dispersion R2 and 85 g of polypropylene wax (mp 145° C.) instead of the wax particle dispersion were used in preparing an aggregated particle dispersion.

The toner thus obtained caused lower transfer efficiency, transfer voids, and filming on a photoconductive member that was attributed to the dispersion of the wax. When the durability of the developer was near 5 k, the amount of charge was decreased, and fog was increased. For fixing, the transmittance was 50% or less.

(14) Preparation of Toner Base m13

A toner base m13 was produced in the same manner as the toner base M1 except that a cationic surface-active agent was not added to the particle dispersion including the resin particles, the colorant particles, and the wax particles. In this case, however, the aggregated particles were not formed stably, and the particle size distribution became broader. Moreover, many wax and pigment particles were not aggregated and suspended in the aqueous medium. The residual wax was attached to the toner base.

(15) Preparation of Toner Base m14

A toner base m14 was produced in the same manner as the toner base M3 except that a cationic surface-active agent was not added to the particle dispersion including the resin particles, the colorant particles, and the wax particles. In this case, however, the aggregated particles were not formed stably, and the particle size distribution became broader. Moreover, many wax and pigment particles were not aggregated and suspended in the aqueous medium. Further, a uniform shell was not provided due to agglomeration of the second resin particles.

Table 4 shows the additives used in this example. The amount of charge was measured by a blow-off method using frictional charge with an uncoated ferrite carrier. Under the environmental conditions of 25° C. and 45% RH, 50 g of carrier and 0.1 g of silica or the like were mixed in a 100 ml polyethylene container, and then stirred by vertical rotation at a speed of 100 $min^{-1}$ for 5 minutes and 30 minutes, respectively. Thereafter, 0.3 g of sample was taken for each stirring time, and a nitrogen gas was blown on the samples at $1.96\times10^4$ (Pa) for 1 minute.

It is preferable that the 5-minute value is −100 to −800 μC/g and the 30-minute value is −50 to −600 μC/g for the negative chargeability. Silica having a high charge amount can function well in a small quantity.

TABLE 4

| Inorganic fine powder | Material | Particle size (nm) | Methanol titration (%) | Moisture absorption (wt %) | Ignition loss (wt %) | Drying loss (wt %) | 5-min value | 30-min value | 5-min/30-min value |
|---|---|---|---|---|---|---|---|---|---|
| S1 | Silica treated with dimethyl silicone oil | 6 | 88 | 0.1 | 24 | 0.2 | −890 | −740 | 83.15 |
| S2 | Silica treated with dimethylpolysiloxane | 16 | 88 | 0.1 | 8.5 | 0.2 | −720 | −520 | 72.22 |
| S3 | Silica treated with dimethyl silicone oil/aluminum distearate | 16 | 88 | 0.12 | 9.5 | 0.2 | −685 | −511 | 74.60 |
| S4 | Silica treated with dimethyl silicone oil | 40 | 89 | 0.10 | 6.8 | 0.2 | −710 | −580 | 81.69 |
| S5 | Titanium oxide treated with trimethylmethoxysilane/zinc stearate | 120 | 89 | 0.10 | 8.9 | 0.2 | −370 | −175 | 47.30 |
| S6 | Silica treated with amino modified silicone oil | 40 | 73 | 0.10 | 12.5 | 0.2 | 280 | 150 | 53.57 |
| S7 | Silica treated with amino modified silicone oil | 120 | 73 | 0.10 | 8.8 | 0.2 | 410 | 320 | 78.05 |

Table 5 shows the toner material compositions used in this example.

TABLE 5

| Toner | Toner base | Additive A | Additive B |
|---|---|---|---|
| TM1 | M1 | S1(1.2) | |
| TM2 | M2 | S2(1.8) | S4(0.5) |
| TM3 | M3 | S3(1.5) | |
| TM4 | M4 | S1(1.0) | S5(1.5) |
| TM5 | M5 | S2(1.5) | S6(0.3) |
| TM6 | M6 | S3(1.5) | S7(0.5) |
| TM7 | M1 | S1(1.2) | S7(0.5) |
| TM8 | M3 | S2(1.8) | S6(0.3) |
| TM9 | M4 | S3(1.5) | S5(1.5) |
| TC1 | m11 | S1(1.2) | |
| TC2 | m12 | S1(1.2) | |
| TC3 | m13 | S1(1.2) | |
| TC4 | m14 | S1(1.2) | |

The number in the parentheses is the amount (parts by weight) of the additive added per 100 parts by weight of the toner base. The external addition treatment was performed by using FM20B with a Z0S0-type mixer blade, an input amount of 1 kg, a number of revolutions of 2000 $min^{-1}$, and a treating time of 5 minutes.

FIG. 1 is a cross-sectional view showing the configuration of a full color image forming apparatus used in this example. In FIG. 1, the outer housing of a color electrophotographic printer is not shown.

A transfer belt unit 17 includes a transfer belt 12, a first color (yellow) transfer roller 10Y, a second color (magenta) transfer roller 10M, a third color (cyan) transfer roller 10C, a fourth color (black) transfer roller 10K, a driving roller 11 made of aluminum, a second transfer roller 14 made of an elastic body, a second transfer follower roller 13, a belt cleaner blade 16 for cleaning a toner image that remains on the transfer belt 12, and a roller 15 located opposite to the belt cleaner blade 16. The first to fourth color transfer rollers 10Y, 10M, 10C, and 10K are made of an elastic body.

A distance between the first color (Y) transfer position and the second color (M) transfer position is 35 mm (which is the same as a distance between the second color (M) transfer position and the third color (C) transfer position and a distance between the third color (C) transfer position and the fourth color (K) transfer position). The circumferential velocity of a photoconductive member is 125 mm/s.

The transfer belt 12 can be obtained by kneading a conductive filler in an insulating resin and making a film with an extruder. In this example, polycarbonate resin (e.g., European Z300 manufactured by Mitsubishi Gas Kagaku Co., Ltd.) was used as the insulating resin, and 5 parts by weight of conductive carbon (e.g., "KETJENBLACK") were added to 95 parts by weight of the polycarbonate resin to form a film. The surface of the film was coated with a fluorocarbon resin. The film had a thickness of about 100 μm, a volume resistance of $10^7$ to $10^{12}\Omega\cdot$cm, and a surface resistance of $10^7$ to $10^{12}\Omega$/sq. The use of this film can improve the dot reproducibility and prevent slackening of the transfer belt 12 over a long period of use or charge accumulation effectively. By coating the film surface with a fluorocarbon resin, the filming of toner on the surface of the transfer belt 12 caused by a long period of use also can be suppressed effectively. When the volume resistance is less than $10^7\Omega\cdot$cm, retransfer is likely to occur. When the volume resistance is more than $10^{12}\Omega\cdot$cm, the transfer efficiency is degraded.

A first transfer roller 10 is a urethane foam roller of conductive carbon and has an outer diameter of 10 mm. The resistance value is $10^2$ to $10^6\Omega$. In the first transfer operation, the first transfer roller 10 is pressed against a photoconductive member 1 with a force of about 1.0 to 9.8 (N) via the transfer belt 12, so that toner is transferred from the photoconductive member 1 to the transfer belt 12. When the resistance value is less than $10^2\Omega$, reverse transfer is likely to occur. When the resistance value is more than $10^6\Omega$, a transfer failure is likely to occur. The force less than 1.0 (N) may cause a transfer failure, and the force more than 9.8 (N) may cause transfer voids.

The second transfer roller 14 is a urethane foam roller of conductive carbon and has an outer diameter of 15 mm. The resistance value is $10^2$ to $10^6\Omega$. The second transfer roller 14 is pressed against the follower roller 13 via the transfer belt 12 and a transfer medium 19 such as a paper or OHP sheet. The follower roller 13 is rotated in accordance with the movement of the transfer belt 12. In the second transfer operation, the second transfer roller 14 is pressed against the follower roller 13 with a force of 5.0 to 21.8 (N), so that toner is transferred from the transfer belt 12 to the transfer medium 19. When the resistance value is less than $10^2\Omega$, reverse transfer is likely to occur. When the resistance value is more than $10^6\Omega$, a transfer failure is likely to occur. The force less than 5.0 (N) may cause a transfer failure, and the force more than 21.8 (N) may increase the load and generate jitter easily.

Four image forming units 18Y, 18M, 18C, and 18K for yellow (Y), 1.

The image forming units 18Y, 18M, 18C, and 18K have the same components except for a developer contained therein. For simplification, only the image forming unit 18Y for yellow (Y) will be described, and an explanation of the other units will not be repeated.

The image forming unit is configured as follows. Reference numeral 1 is a photoconductive member, 3 is pixel laser signal light, and 4 is a developing roller of aluminum that has an outer diameter of 12 mm and includes a magnet with a magnetic force of 1200 gauss. The developing roller 4 is located opposite to the photoconductive member 1 with a gap of 0.3 mm between them, and rotates in the direction of the arrow. A stirring roller 6 stirs toner and a carrier in a developing unit and supplies the toner to the developing roller 4. The mixing ratio of the toner to the carrier is read from a permeability sensor (not shown), and the toner is supplied timely from a toner hopper (not shown). A magnetic blade 5 is made of metal and controls a magnetic brush layer of a developer on the developing roller 4. In this example, 150 g of developer was introduced, and the gap was 0.4 mm. Although a power supply is not shown in FIG. 1, a direct voltage of −500 V and an alternating voltage of 1.5 kV (p-p) at 6 kHz were applied to the developing roller 4. The circumferential velocity ratio of the photoconductive member 1 to the developing roller 4 was 1:1.6. The mixing ratio of the toner to the carrier was 93:7. The amount of developer in the developing unit was 150 g.

A charging roller 2 is made of epichlorohydrin rubber and has an outer diameter of 12 mm. A direct-current bias of −1.2 kV is applied to the charging roller 2 for charging the surface of the photoconductive member 1 to −600 V. Reference numeral 8 is a cleaner, 9 is a waste toner box, and 7 is a developer.

A paper is conveyed from the lower side of the transfer belt unit 17, and a paper conveying path is formed so that a paper 19 is transported by a paper feed roller (not shown) to a nip portion where the transfer belt 12 and the second transfer roller 14 are pressed against each other.

Toner on the transfer belt 12 is transferred to the paper 19 by +1000 V applied to the second transfer roller 14, and then is conveyed to a fixing portion in which the toner is fixed. The fixing portion includes a fixing roller 201, a pressure roller 202, a fixing belt 203, a heat roller 204, and an induction heater 205.

Figure 2:
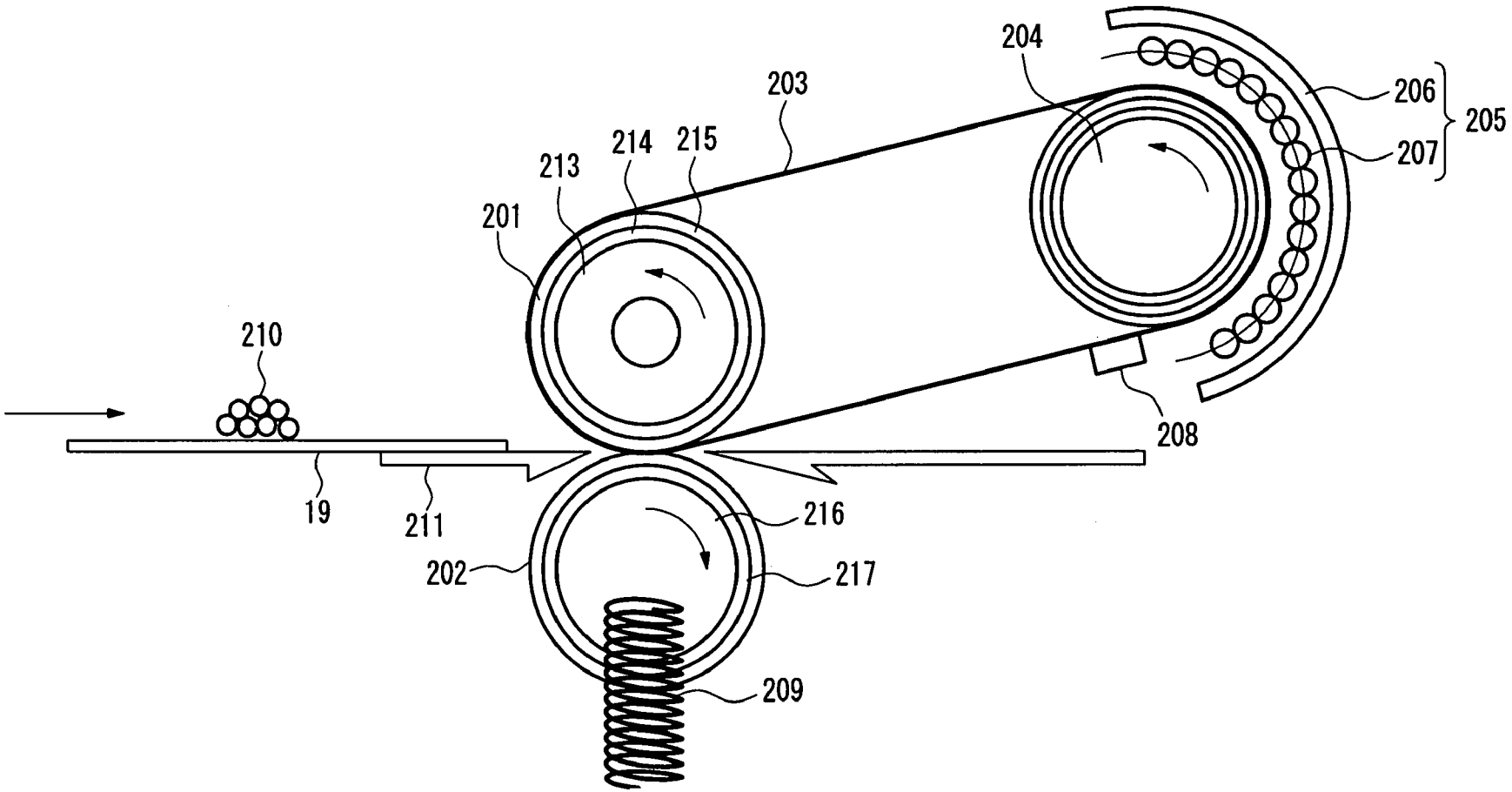
FIG. 2 is a cross-sectional view showing the configuration of a fixing unit used in an example of the present invention.

FIG. 2 shows a fixing process. A belt 203 runs between the fixing roller 201 and the heat roller 204. A predetermined load is applied between the fixing roller 201 and the pressure roller 202 so that a nip is formed between the belt 203 and the pressure roller 202. The induction heater 205 including a ferrite core 206 and a coil 207 is provided on the periphery of the heat roller 204, and a temperature sensor 208 is arranged on the outer surface. The belt 203 is formed by arranging a Ni substrate (30 μm), silicone rubber (150 μm), and PFA (tetrafluoroethylene-perfluoroalkyl vinyl ether copolymer) (30 μm) in layers. The pressure roller 202 is pressed against the fixing roller 201 by a spring 209. A recording material 19 with toner 210 is moved along a guide plate 211. The fixing roller 201 (fixing member) includes a hollow core 213, an elastic layer 214 formed on the hollow core 213, and a silicone rubber layer 215 formed on the elastic layer 214. The hollow core 213 is made of aluminum and has a length of 250 mm, an outer diameter of 14 mm, and a thickness of 1 mm. The elastic layer 214 is made of silicone rubber with a rubber hardness (JIS-A) of 20 degrees based on the JIS standard and has a thickness of 3 mm. The silicone rubber layer 215 has a thickness of 3 mm. Therefore, the outer diameter of the fixing roller 201 is about 20 mm. The fixing roller 201 is rotated at 125 mm/s by receiving a driving force from a driving motor (not shown).

The heat roller 204 includes a hollow pipe having a thickness of 1 mm and an outer diameter of 20 mm. The surface temperature of the fixing belt is controlled to 170° C. by using a thermistor.

The pressure roller 202 (pressure member) has a length of 250 mm and an outer diameter of 20 mm, and includes a hollow core 216 and an elastic layer 217 formed on the hollow core 216. The hollow core 216 is made of aluminum and has an outer diameter of 16 mm and a thickness of 1 mm. The elastic layer 217 is made of silicone rubber with a rubber hardness (JIS-A) of 55 degrees based on the JIS standard and has a thickness of 2 mm. The pressure roller 202 is mounted rotatably, and a 5.0 mm width nip is formed between the pressure roller 202 and the fixing roller 201 under a one-sided load of 147N given by the spring 209.

The operations will be described below. In the full color mode, all the first transfer rollers 10 of Y, M, C, and K are lifted and pressed against the respective photoconductive members 1 of the image forming units via the transfer belt 12. At this time, a direct-current bias of +800 V is applied to each of the first transfer rollers 10. An image signal is transmitted through the laser beam 3 and enters the photoconductive member 1 whose surface has been charged by the charging roller 2, thus forming an electrostatic latent image. The electrostatic latent image formed on the photoconductive member 1 is made visible by toner on the developing roller 4 that is rotated in contact with the photoconductive member 1.

In this case, the image formation rate (125 mm/s, which is equal to the circumferential velocity of the photoconductive member) of the image forming unit 18Y is set so that the speed of the photoconductive member is 0.5 to 1.5% slower than the traveling speed of the transfer belt 12.

In the image forming process, signal light 3Y is input to the image forming unit 18Y, and an image is formed with Y toner. At the same time as the image formation, the Y toner image is transferred from the photoconductive member 1Y to the transfer belt 12 by the action of the first transfer roller 10Y, to which a direct voltage of +800 V is applied.

There is a time lag between the first transfer of the first color (Y) and the first transfer of the second color (M). Then, signal light 3M is input to the image forming unit 18M, and an image is formed with M toner. At the same time as the image formation, the M toner image is transferred from the photoconductive member 1M to the transfer belt 12 by the action of the first transfer roller 10M. In this case, the M toner is transferred onto the first color (Y) toner that has been formed on the transfer belt 12. Subsequently, the C toner and K toner images are formed in the same manner and transferred by the action of the first transfer rollers 10C and 10K. Thus, YMCK toner images are formed on the transfer belt 12. This is a so-called tandem process.

A color image is formed on the transfer belt 12 by superimposing the four color toner images in registration. After the last transfer of the K toner image, the four color toner images are transferred collectively to the paper 19 fed by a feeding cassette (not shown) at matched timing by the action of the second transfer roller 14. In this case, the follower roller 13 is grounded, and a direct voltage of +1 kV is applied to the second transfer roller 14. The toner images transferred to the paper 19 are fixed by a pair of fixing rollers 201 and 202. Then, the paper 19 is ejected through a pair of ejecting rollers (not shown) to the outside of the apparatus. The toner that is not transferred and remains on the transfer belt 12 is cleaned by the belt cleaner blade 16 to prepare for the next image formation.

Table 6 shows the results of visual images formed by the electrophotographic apparatus in FIG. 1. In this case, a transfer failure in the character portion of a full color image with three colors of toner and the winding of a paper around the fixing belt were evaluated. The amount of charge was measured by a blow-off method using frictional charge with a ferrite carrier. Under the environmental conditions of 25° C. and 45% RH, 0.3 g of sample was taken to evaluate the durability, and a nitrogen gas was blown on the sample at $1.96\times10^4$ (Pa) for 1 minute. The acceptable level of the image density was 1.3 or more. The evaluations of fog, uniformity of a solid image, transfer skipping in letters, reverse transfer, and transfer voids were represented by ○ (good), Δ (somewhat worse), and X (unsuitable for practical use).

TABLE 6

| Developer | Toner | Carrier | Filming on photoconductive member | Image density (ID) initial/after test | Fog | Uniformity of solid image | Transfer skipping in letters | Reverse transfer | Transfer voids |
|---|---|---|---|---|---|---|---|---|---|
| DM11 | TM1 | A1 | Not occur | 1.49/1.52 | ○ | ○ | ○ | ○ | ○ |
| cm1 | TM2 | b1 | Not occur | 1.34/1.28 | ○ | Δ | ○ | Δ | Δ |
| DM12 | TM3 | A2 | Not occur | 1.47/1.51 | ○ | ○ | ○ | ○ | ○ |
| DM13 | TM4 | A3 | Not occur | 1.52/1.53 | ○ | ○ | ○ | ○ | ○ |
| DM14 | TM5 | A4 | Not occur | 1.34/1.32 | ○ | ○ | ○ | ○ | ○ |
| cm2 | TM6 | b2 | Not occur | 1.38/1.23 | ○ | Δ | ○ | Δ | Δ |
| cm3 | TM7 | b3 | Not occur | 1.41/1.29 | ○ | Δ | ○ | Δ | Δ |
| DM15 | TM8 | A1 | Not occur | 1.44/1.47 | ○ | ○ | ○ | ○ | ○ |
| DM16 | TM9 | A2 | Not occur | 1.49/1.45 | ○ | ○ | ○ | ○ | ○ |
| DM17 | TM3 | A3 | Not occur | 1.48/1.45 | ○ | ○ | ○ | ○ | ○ |
| DM18 | TM4 | A4 | Not occur | 1.41/1.39 | ○ | ○ | ○ | ○ | ○ |
| cm4 | tm11 | A1 | Occur | 1.37/1.32 | Δ | Δ | X | X | X |
| cm5 | tm12 | A2 | Occur | 1.48/1.39 | Δ | Δ | X | X | X |
| cm6 | tm13 | A3 | Occur | 1.48/1.42 | Δ | Δ | X | X | X |
| cm7 | tm14 | A4 | Occur | 1.34/1.29 | Δ | Δ | X | X | X |
| cm8 | tm11 | b1 | Occur | 1.21/1.02 | X | X | X | X | X |
| cm9 | tm12 | b2 | Occur | 1.46/1.25 | X | X | X | X | X |
| cm10 | tm13 | b3 | Occur | 1.23/0.97 | X | X | X | X | X |
| cm11 | tm14 | b4 | Occur | 1.48/1.23 | X | X | X | X | X |

When visual images were formed by using the developers DM11 to DM18, there was no disturbance in horizontal lines, no scattering toner, and no transfer void. The black solid images were uniform, and images with significantly high resolution and high quality were reproduced even at 16 lines per mm. Moreover, high-density images having an image density of not less than 1.3 were obtained. When a white image was taken after successively printing 10 copies of the solid image, no background fog was present in the non-image portions.

Subsequently, when a solid image was taken, a supply or mixing failure of the toner and the carrier did not occur, and a developing memory was not generated.

In the long period durability test after 300,000 copies of A4 paper, the flowability and the image density were not changed very much, and the characteristics were stable. There was almost no spent of the toner components on the carrier. A change in carrier resistance was reduced, a decrease in charge amount was suppressed, and no fog was caused. The amount of charge hardly varied under high temperature and high humidity conditions as well as low temperature and low humidity conditions.

The transfer voids were not a problem for practical use, and reverse transfer occurred to a lesser extent. The transfer efficiency was about 95%. In the case of a full color image formed by superimposing three colors, a transfer failure and reverse transfer did not occur.

The filming of the toner on the photoconductive member or the transfer belt was not a problem for practical use. Moreover, a cleaning failure of the photoconductive member or the transfer belt did not occur.

Even with a full color image, there was almost no disturbance or scattering of the toner during fixing, and a paper was not wound around the fixing belt.

When the developers cm1 to cm3 were used at a process speed of 100 mm/s while the photoconductive members were spaced 70 mm apart, the transfer voids, skipping in letters during transfer, and reverse transfer were acceptable levels. However, when the process speed was increased to 120 mm/s or the distance between the photoconductive members was 60 mm, transfer voids and reverse transfer occurred, and the characteristics were degraded. The solid image uniformity also was somewhat reduced (indicated by Δ).

For the developers cm4 to cm11, transfer voids and reverse transfer were increased, and a cleaning failure of the photoconductive member or the transfer belt was caused. The filming of the toner on the photoconductive member and fog also occurred considerably.

Moreover, spent of the toner on the carrier was increased, and the carrier resistance was changed significantly. Further, the amount of charge was decreased, and fog was likely to be larger. Under high temperature and high humidity conditions, fog was increased due to a reduction in charge amount. Under low temperature and low humidity conditions, the image density was reduced due to an increase in charge amount. The transfer efficiency was decreased to about 60% to 70%. When a solid image was taken for development, the image got blurred with repeated operation. The wax adhered to the developing blade, and unusual images with vertical strips were formed during continuous use. In outputting an image of three superimposed colors, a paper was wound around the fixing belt. The toner scattered during fixing.

Next, an offset resistance test was conducted in the following manner. A solid image was fixed on an OHP sheet in an amount of 1.2 g/cm$^2$ or more at a process speed of 100 mm/s by using a fixing device provided with an oilless belt. Table 7 shows the results. The toner of TM 1 to TM6 did not cause paper jam in the nip portion. When a green solid image was fixed on a plain paper, no offset occurred until 122,000 copies. Even if a silicone or fluorine-based fixing belt was used without oil, the surface of the belt did not wear. The transmittance and the offset resistance at high temperatures were evaluated. In this case, the process speed was 100 mm/s, and the fixing temperature was 180° C. The transmittance was measured with 700 nm light by using a spectrophotometer (U-3200 manufactured by Hitachi, Ltd.). The evaluations of fixability, offset resistance, and storage stability were shown in Table 7.

TABLE 7

| | OHP transmittance (%) | High-temperature offset generation (° C.) | Storage test | Winding around fixing belt | Toner disturbance during fixing |
|---|---|---|---|---|---|
| TM1 | 92.5 | 220 | ○ | Not occur | None |
| TM2 | 93.5 | 230 | ○ | Not occur | None |
| TM3 | 91.8 | 230 | ○ | Not occur | None |
| TM4 | 90.1 | 230 | ○ | Not occur | None |
| TM5 | 87.8 | 220 | ○ | Not occur | None |
| TM6 | 87.8 | 230 | ○ | Not occur | None |
| tm11 | 48.2 | 170 | X | Occur | Scattering |
| tm12 | 47.8 | 160 | X | Occur | Scattering |
| tm13 | 75.8 | 180 | X | Occur | Scattering |
| tm14 | 68.4 | 170 | X | Occur | Scattering |

As shown in Table 7, the OHP transmittance of TM1 to TM6 was 80% or more. TM1 to TM6 also had a high offset temperature of 220° C. or more and exhibited favorable fixability when the fixing roller was used without oil. Moreover, agglomeration hardly was observed under the storage conditions of 60° C. for 5 hours. For the toner of tm11 to tm14, however, agglomeration was observed in the storage test, and the temperature range of offset resistance was narrow.

The invention claimed is:

1. A method for producing toner comprising:

(i) forming aggregated particles in an aqueous medium by mixing and aggregating (a) a first resin particle dispersion in which first resin particles are dispersed in a surface-active agent, (b) a colorant particle dispersion in which colorant particles are dispersed in a surface-active agent having the same polarity as that of the surface-active agent for the first resin particle dispersion, (c1) a wax particle dispersion in which at least ester wax that has an iodine value of not more than 25, a saponification value of 30 to 300, and an endothermic peak temperature (melting point) of 50° C. to 100° C. based on a DSC method is dispersed in a surface-active agent having the opposite polarity to that of the surface-active agent for the first resin particle dispersion, or (c2) a wax particle dispersion in which at least wax that is obtained by a reaction of alkyl alcohol having a carbon number of 4 to 30, unsaturated polycarboxylic acid or its anhydride, and unsaturated hydrocarbon wax and has an acid value of 1 to 80 mgKOH/g and an endothermic peak temperature (melting point) of 50° C. to 120° C. based on the DSC method is dispersed in a surface-active agent having the opposite polarity to that of the surface-active agent for the first resin particle dispersion, and (d) a surface-active agent having the same polarity as that of the surface-active agent for the wax particle dispersion that is added to the aqueous medium in addition to the surface-active agent in the wax particle dispersion, (ii) forming melted particles by heating the aggregated particles for a predetermined time in the aqueous medium;

(iii) mixing the melted particles with a second resin particle dispersion in which second resin particles are dispersed in a surface-active agent (e) so that the second resin particles adhere to the melted particles; and (iv) forming fused films of the second resin particles on surfaces of the melted particles by heating.

2. The method according to claim 1, wherein in a molecular weight distribution of the ester wax based on gel permeation chromatography (GPC), a number-average molecular weight is 100 to 5000, a weight-average molecular weight is 200 to 10000, a ratio (weight-average molecular weight/number-average molecular weight) of the weight-average molecular weight to the number-average molecular weight is 1.01 to 8, a ratio (Z average molecular weight/number-average molecular weight) of the Z average molecular weight to the number-average molecular weight is 1.02 to 10, and there is at least one molecular weight maximum peak in a range of $5\times10^2$ to $1\times10^4$, and the ester wax has a heating loss of not more than 8 wt % at 220° C.

3. The method according to claim 1, wherein the melted particle dispersion has a pH of 7 to 10, and the second resin particles are mixed with and adhere to the melted particles by adding an inorganic metal salt.

4. The method according to claim 3, wherein the particles are separated from the water by filtration.

5. The method according to claim 1, wherein an additive is added further to the surface of the toner and the additive is silica whose surface is treated with at least one selected from the group consisting of fatty acid ester, fatty acid antide, and a fatty acid metal salt.

6. The method according to claim 5, wherein an additive is added further to the surface of the toner, and as the additive, 0.5 to 2.5 parts by weight of inorganic fine powder having an average particle size of 6 nm to 20 nm and an ignition loss of 1.5 to 25 wt %, and 1.0 to 3.5 parts by weight of inorganic fine powder having an average particle size of 30 nm 200 nm and an ignition loss of 0.5 to 23 wt % are added to 100 parts by weight of toner base particles.

7. The method according to claim 1, wherein an additive is added further to the surface of the toner, and as the additive, 0.5 to 2.5 parts by weight of inorganic fine powder having an average particle size of 6 nm to 20 nm and an ignition loss of 1.5 to 25 wt %, 1.0 to 3.5 parts by weight of inorganic fine powder having an average particle size oF 30 nm to 200 nm and an ignition loss of 0.5 to 23 wt %, and 0.5 to 1.5 parts by weight of positively charged inorganic fine powder having an average particle size of 6 nm 200 nm and an ignition loss of 0.5 to 25 wt % are added to 100 parts by weight of toner base particles.

8. The method according to claim 1, wherein lauryl amine hydrochloride or stearic acid amine hydrochloride is used as a surface-active agent for the wax particle dispersion.

9. The method according to claim 1, wherein polyvinyl alcohol or water-soluble cellulose is used with lauryl amine hydrochloride or stearic acid amine hydrochloride as a surface-active agent for the wax particle dispersion.

10. The method according to claim 1, wherein the wax in the wax particle dispersion (c2) has a weight-average molecular weight of 1000 to 6000, a Z average molecular weight of 1500 to 9000, a ratio (weight-average molecular weight/number-average molecular weight) of the weight-average molecular weight to the number-average molecular weight of 1.1 to 3.8, a ratio (Z average molecular weight/number-average molecular weight) of the Z average molecular weight to the number-average molecular weight of 1.5 to 6.5, and at least one molecular weight maximum peak in a rangeofi $1\times10^3$ to $3\times10^4$.

* * * * *